United States Patent [19]

Wendt et al.

[11] Patent Number: 5,052,521

[45] **Date of Patent: * Oct. 1, 1991**

[54] STAIRWAY WHEELCHAIR LIFT

[75] Inventors: David W. Wendt, Minona; John F. Prendergast, Sr., Franklin; Hyun Liu, Milwaukee; Edward T. Gisske, Verona, all of Wis.

[73] Assignee: The Cheney Company, New Berlin, Wis.

[ * ] Notice: The portion of the term of this patent subsequent to Feb. 27, 2007 has been disclaimed.

[21] Appl. No.: 195,252

[22] Filed: May 18, 1988

[51] Int. Cl.[5] ..... B66B 9/20

[52] U.S. Cl. ..... 187/12; 187/17; 187/8.65; 187/88; 414/921; 318/649; 182/2; 182/148

[58] Field of Search ..... 187/12, 13, 14, 88, 187/89, 8.65, 9 R, 17; 414/921; 340/307; 341/176; 455/603; 318/649; 182/2, 148

[56] References Cited

U.S. PATENT DOCUMENTS

| | | | |
|---|---|---|---|
| 3,749,202 | 7/1973 | Puls | 187/12 |
| 4,124,130 | 11/1978 | Rohrs et al. | 414/921 X |
| 4,179,012 | 12/1979 | Heberle | 187/12 |
| 4,354,575 | 10/1982 | Andersson | 187/12 |
| 4,479,753 | 10/1984 | Thorley | 414/921 X |
| 4,493,602 | 1/1985 | Koerber | 414/921 X |
| 4,496,942 | 1/1985 | Matsuoka | 341/176 X |
| 4,627,517 | 12/1986 | Bor | 182/12 |
| 4,664,584 | 5/1987 | Braun et al. | 414/921 |
| 4,685,860 | 8/1987 | McFarland | 414/921 |
| 4,843,639 | 6/1989 | Beals | 455/603 |

FOREIGN PATENT DOCUMENTS

| | | | |
|---|---|---|---|
| 3115778 | 11/1982 | Fed. Rep. of Germany | 187/12 |

*Primary Examiner*—Michael S. Huppert
*Assistant Examiner*—Kenneth R. DeRosa
*Attorney, Agent, or Firm*—Michael, Best & Friedrich

[57] ABSTRACT

A stairway wheelchair lift includes a stationary motor drive unit, a rail assembly extending along the stairway and a mobile platform movable along the rail. A flexible drive member, such as a chain or cable, within the rail assembly, is driven by the motor drive unit and is connected to the mobile platform to move the platform in either direction along the rail. The mobile platform is adapted to support and transport a wheelchair-bound passenger during use, and to fold upwardly out of the way of the stairway when the lift is not in use. An automatically actuated brake mechanism stops further movement of the mobile platform when the speed of the platform relative to the rail exceeds a predetermined threshold, and a plurality of safety sensing switches prevent operation of the lift in the presence of obstructions along the stairway or other unsafe conditions.

27 Claims, 12 Drawing Sheets

STAIRWAY WHEELCHAIR LIFT

BACKGROUND OF THE INVENTION

This invention relates generally to lift mechanisms and, more particularly, to a stairway wheelchair lift operable to transport a handicapped person in ascending and descending directions along a stairway.

The increasing public awareness of the rights and needs of handicapped individuals has led to various improvements which provide handicapped persons, and, in particular, those confined to a wheelchair, with access to formerly inaccessible locations. Although horizontal movement by handicapped persons has been greatly facilitated by the widespread use of sidewalk, entrance way and curb ramps, and the like, vertical movement, and in Particular, vertical travel between the floors of a multi-story building, has long been a formidable obstacle.

In larger multi-story structures, such as those having four or more stories, elevators provide a popular and convenient form of transportation between floors. Such elevators, provided they are accessible to and easily operated by handicapped persons, offer a convenient means for transporting handicapped persons between floors.

In smaller multi-story structures, however, where, for various reasons, such as cost and/or architectural limitations, the installation of an elevator system is impractical, some other system must be provided to permit handicapped persons access to all floors. As a rule, such smaller structures include one or more stairways between floors, and one known approach has been to provide a stairway lift mechanism installable along an existing stairway and operable to transport a wheelchair-bound person, between floors along the stairway.

To be effective, a stairway lift mechanism must be safe, reliable and easily operated by persons whose movement is often severely limited. As stairway lift mechanisms typically move along the same stairway used by other, non-handicapped people, it is also desirable that such mechanisms avoid, to the extent possible, interference with general use of the stairway both when a passenger is being transported and when the mechanism is standing idle. Furthermore, because stairways can differ considerably from one structure to the next, it is often necessary to adapt a stairway lift mechanism for installation in a particular stairway on a more or less custom basis. Accordingly, a stairway lift system which can be readily and economically adapted for use in various particular stairways regardless of the physical constraints thereby imposed, will not only provide significant economic benefits, but will also encourage more widespread use of the system and, thus, confer a corresponding benefit on the handicapped population.

In view of the foregoing, it is a general object of the present invention to provide a new and improved stairway wheelchair lift.

It is a more specific object of the Present invention to provide a new and improved wheelchair lift which is safe and reliable, and which can be easily operated by a handicapped person.

It is still a further object of the present invention to provide a stairway lift which can be readily and economically adapted for use with particular stairways.

The invention provides a lift mechanism for transporting a passenger between first and second vertically displaced locations separated by stairs. The lift mechanism comprises a rail extending along the stairs and a drive chain movable within the rail. A motor drive unit is adapted to operatively drive the chain, and a movable passenger lift platform is coupled to the chain and is adapted to ride along the rail in response to driving movement of the chain. A position sensor is included for sensing the position of the lift platform, and a control, responsive to the sensor, is provided for controlling the movement of the platform in accordance with the position of the platform along the stairway.

The invention also provides a stairway wheelchair lift comprising a substantially planar vertical housing which has a lower and an upper end, and which is adapted to be supported for movement along a rail. The lift further includes a generally planar platform, having a load supporting surface, pivotally joined adjacent the lower end of the vertical housing for movement between a raised position, wherein the platform is substantially parallel to the vertical housing, and a lowered position, wherein the platform extends substantially perpendicularly outwardly from the vertical housing. A first elongate guard arm is coupled to the vertical housing adjacent the upper end and is movable between a raised position, wherein the first arm extends upwardly from the vertical housing, and a lowered position, wherein the arm extends substantially perpendicularly outwardly from the vertical housing. A second elongate guard arm is coupled to the vertical housing adjacent the upper end and is movable between a raised position, wherein the second arm extends upwardly from the vertical housing and a lowered Position wherein the second arm extends substantially perpendicularly outwardly from the vertical housing.

The invention also provides a chain comprising a first metallic chain link having opposite ends, at least one of which ends is coated with a nonmetallic coating, and a second metallic chain link having opposite ends, at least one of which ends interlocks with the coated end of the first link such that metal to metal contact between the interlocking ends is substantially avoided. A first generally spherical rigid member is molded onto the first link and surrounds a portion of the first link between the opposite ends of said first link. A second generally spherical rigid member is molded onto the second link and surrounds a portion of the second link between the opposite ends of the second link. In one embodiment, each of the spherical rigid members includes a pair of side-by-side notches for receiving an externally applied driving force.

The invention also provides a motor drive unit for powering a drive chain. The motor drive unit comprises a frame, a gear box supported by the frame, and a sprocket carried by the gear box. The sprocket is adapted to support and drive the drive chain, and a tensioning mechanism is provided for adjusting the position of the gear box with respect to the frame to provide adjustment of tension of the drive chain.

The invention also provides a drive sprocket adapted to be mounted on a rotatable shaft and operable to drive a chain of the type having a plurality of interlocking links and a drive member, having a pair of side-by-side notches, molded around each of the links. The drive sprocket comprises a first side plate which is adapted to be mounted on the rotatable shaft and has an outer periphery adapted to engage one of the side-by-side notches in each of a plurality of the drive members. The drive sprocket further comprises a second side plate which is adapted to be mounted on the rotatable shaft and which includes an outer periphery adapted to engage the other of the side-by-side notches in each of the plurality of drive members.

The invention also provides a carrier for supporting a passenger lift platform for movement along the rail assembly of a passenger stairway lift mechanism wherein a drive chain is housed within the rail assembly. The carrier comprises a platform support bracket for supporting the passenger lift platform, a coupling mechanism for coupling the Platform support bracket to the chain within the rail assembly, and a pair of opposed brake members housed within the rail assembly adjacent the coupling mechanism. The carrier further comprises a wedge member coupled to the platform support bracket and drivable between the opposed brake members to bias the brake members outwardly into engagement with the rail assembly. The wedge member is movable between an extended position, wherein the brake members are biased outwardly into engagement with the rail assembly with sufficient force to substantially prevent movement of the platform support bracket, and a retracted position wherein the brake members do not engage the rail assembly with sufficient force to substantially prevent movement of the platform support bracket. The carrier also includes a brake control mechanism responsive to a control input for causing the wedge member to move from the retracted Position to the extended position in response to the control input whereby movement of the platform support bracket is substantially prevented following response of the brake control mechanism to the control input. In one embodiment, the control input is generated when the speed of the carrier relative to the rail exceeds a predetermined threshold.

BRIEF DESCRIPTION OF THE DRAWINGS

The features of the present invention which are believed to be novel are set forth with particularity in the appended claims. The invention, together with the further objects and advantages thereof, may best be understood by reference to the following description, taken in conjunction with the accompanying drawings, in the several figures of which like reference numerals identify like elements, and in which:

FIG. 29 is a bottom plan view of a pair of opposed brake members incorporated in the carrier illustrated in FIG. 28.

DESCRIPTION OF THE PREFERRED EMBODIMENT

Figure 2:
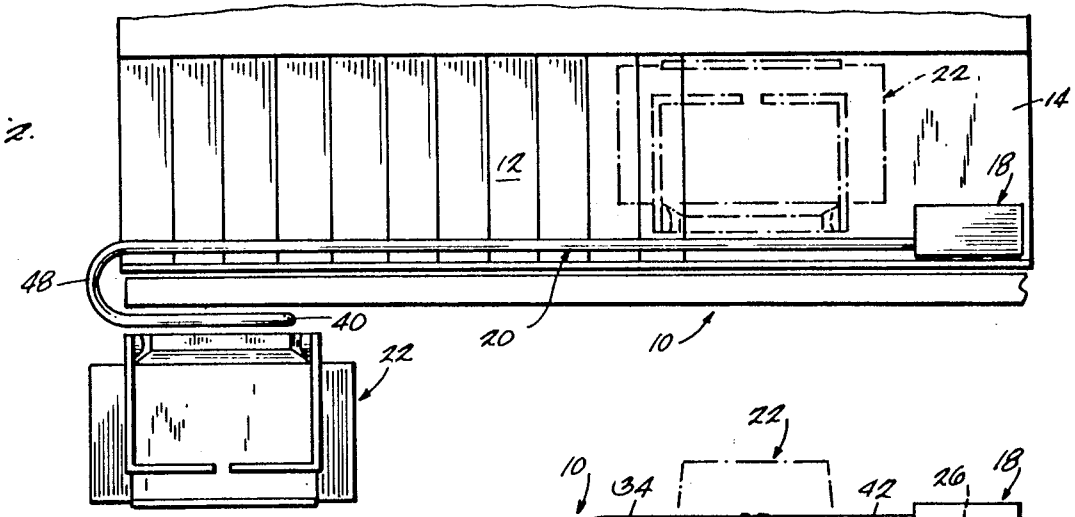
FIG. 2 is a top plan view of the stairway and stairway lift mechanism illustrated in FIG. 1.
Figure 1:
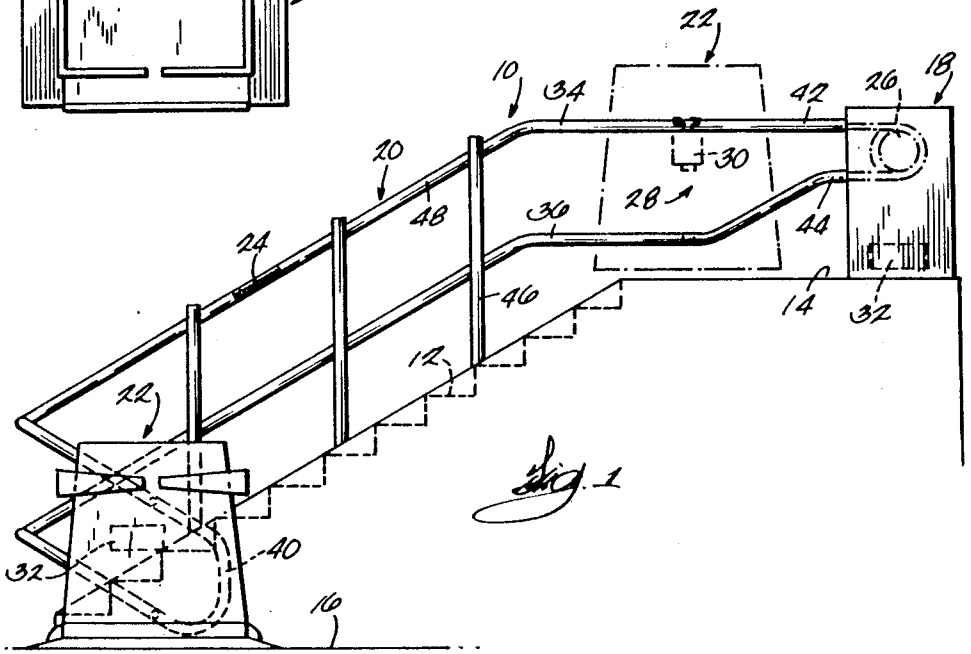
FIG. 1 is a side elevational view of a stairway having associated therewith a stairway lift mechanism constructed in accordance with the invention.
Figure 3:
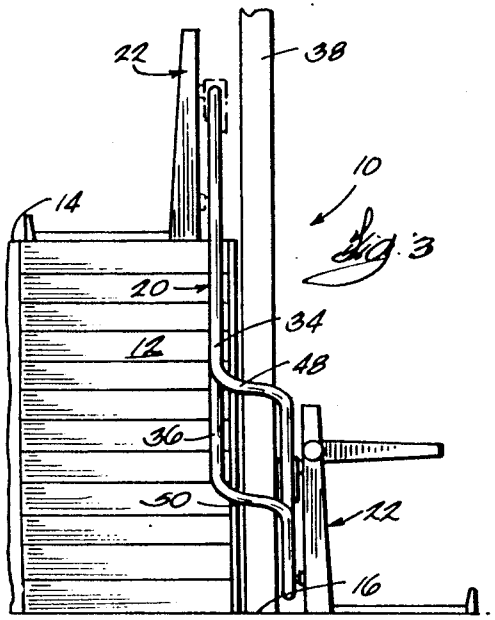
FIG. 3 is a front elevational view of the stairway and stairway lift mechanism illustrated in FIGS. 1 and 2.

Referring to the drawings, and, in particular, to FIGS. 1, 2 and 3, a stairway wheelchair lift mechanism 10 is shown installed along a stairway 12 in a multi-story structure. The lift mechanism 10 is operable to transport a wheelchair-bound passenger between two or more vertically displaced locations, such as upper and lower landings 14 and 16 separated by the stairway. Although the lift mechanism 10 illustrated is adapted for transporting a passenger between only two floors of the multi-story structure, it will be appreciated that the mechanism can be readily adapted for use in structures having more than two floors.

As illustrated, the stairway lift mechanism includes a motor drive unit 18 located at the upper landing, a rail assembly 20 extending from the motor drive unit to the lower landing 16 along the stairway 12, and a passenger lift platform 22 adapted to support and move a passenger along the rail assembly 20. A flexible drive member 24 is disposed within the hollow interior of the rail assembly, and the motor drive unit 18 includes a sprocket 26 adapted to operatively drive the flexible drive member 24 for bi-directional movement within the hollow rail. While in the illustrated arrangement, the flexible drive member is shown as comprising a chain, in other constructions the flexible drive member can comprise a cable or other such structure. The passenger lift platform 22 includes a carrier system 28 having an upper carrier assembly 30 which is coupled to the flexible drive member 24 and which allows the passenger lift platform 22 to ride along the rail assembly 12 in response to driving movement of the flexible drive member 24.

An electrical control system 32, having components located within the motor drive unit 18, the passenger lift platform 22 and within the stairway 12 itself, is provided for controlling the overall operation of the stairway lift mechanism 10. In particular, the electrical control system 32 functions to sense the position of the passenger lift platform 22 and to control movement of the passenger lift platform 22 in accordance with the position of the platform and with various commands generated by users and automatically by the system itself. To this end, the electrical control system 32 includes first and second wireless links operative, respectively, to communicate data from the passenger lift platform 22 to the motor drive unit 18 and from the motor drive unit 18 to the passenger lift platform. Preferably, the first and second wireless links comprise infrared links, and the electrical control system includes a microprocessor-based micro-controller in each of the motor drive unit 18 and the passenger lift platform 22.

As illustrated, the passenger lift Platform 22 Provides a stable horizontal platform surface capable of supporting thereon a wheelchair-bound passenger. The passenger lift platform 22 is capable of movement in both the ascending and descending directions along the stairway 12 between the upper and lower landings 14 and 16 and can thus function to transport the passenger between the landings in either direction along the stairway.

In the description which follows, each of the major elements of the stairway lift mechanism as set forth above will be dealt with in turn.

The Electrical Control System

Figure 30:
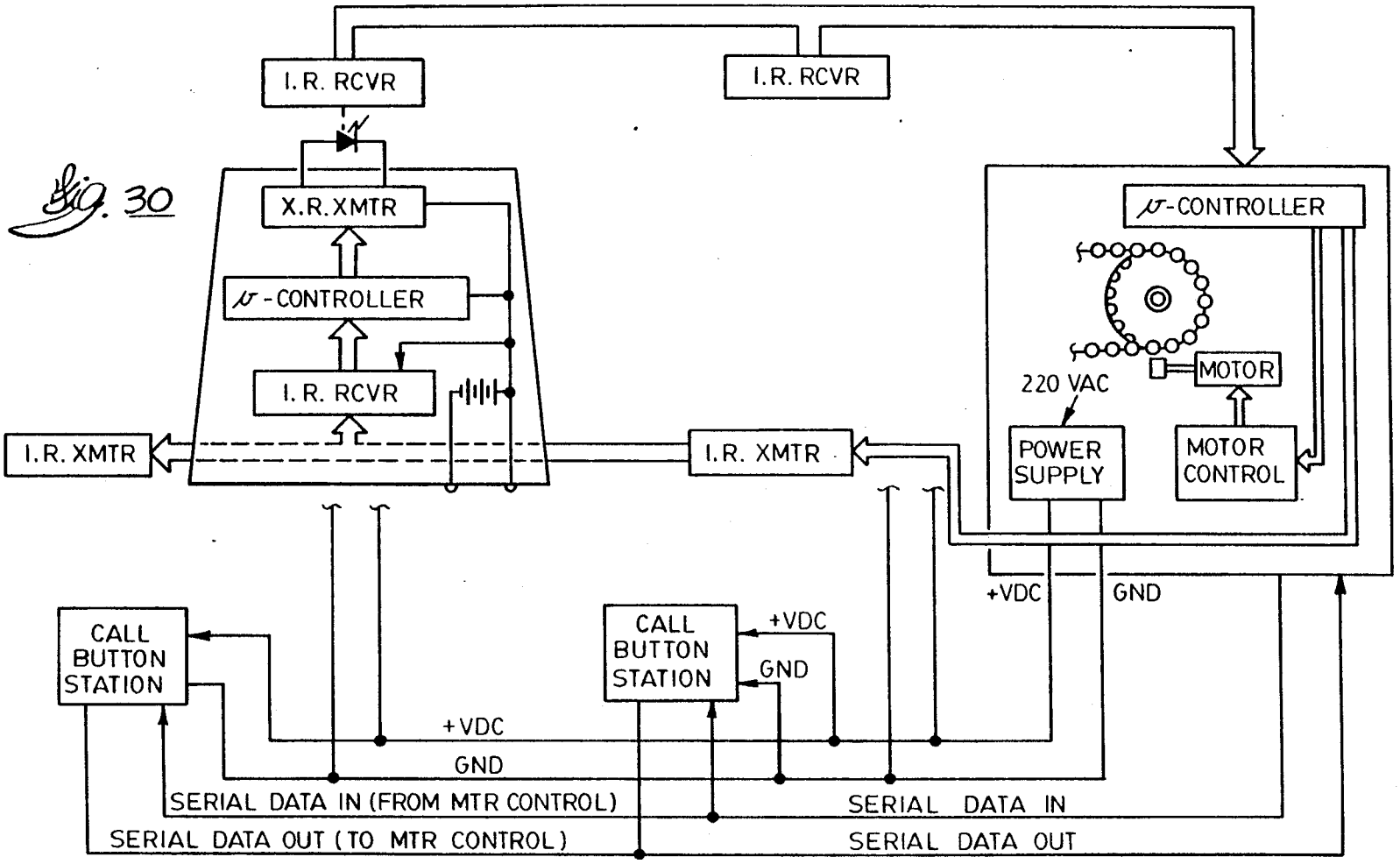
FIG. 30 is a block diagram of an electrical control system embodying various features of the invention.

The electrical control system 32 is shown in FIG. 30 and described in the co-pending application of Edward T. Gisske et al., entitled "Electrical Control System for Stairway Wheelchair Lift", now U.S. Pat. No. 4,904,916, filed concurrently herewith and incorporated by reference herein. FIG. 30 is identical to FIG. 4 of U.S. Pat. No. 4,904,916 with reference numerals removed.

The Rail Assembly

The rail assembly 20 provides a pair of substantially parallel, vertically spaced upper and lower guide rails 34 and 36 extending along one wall 38 of the stairway 12 between the upper landing 14 and the lower landing 16. Preferably, the rail assembly 20 comprises a single continuous length of hollow rigid tubing, made of steel or other such rigid durable material, and formed into a loop having a generally U-shaped lower end 40 adjacent the lower landing 16 and a pair of vertically spaced upper ends 42 and 44 connected to the motor drive unit 18 adjacent the upper landing 14. As illustrated, the rigid tubing forming the rail assembly 20 is shaped so as to conform generally to the course of the stairway 12. The rail assembly is supported above, and generally parallel to, the stairway by means of a plurality of stanchions 46 projecting upwardly from the stairway. Alternatively, the rail assembly can be supported on a plurality of supports (not shown) extending outwardly from the wall along the stairway.

The hollow rigid tubing forming the rail assembly is dimensioned to receive therein the drive chain 24. Access to the chain from the exterior of the rail assembly 20 is provided by means of a slot 48 formed in the underside of the upper rail 34.

As further illustrated in FIGS. 1, 2 and 3, the rail assembly 20 is installed along one side of the stairway adjacent the wall 38. In those stairways wherein the direction of the stairway changes radically, such as, for example, in stairways linking three or more floors such that the course of the stairway reverses from floor to floor, the rail assembly 20 is provided with whatever curved segments, such as upper and lower 180° bends 48 and 50, are required to enable the rail mechanism to follow the course of the stairway.

The Passenger Lift Platform

Figure 5:
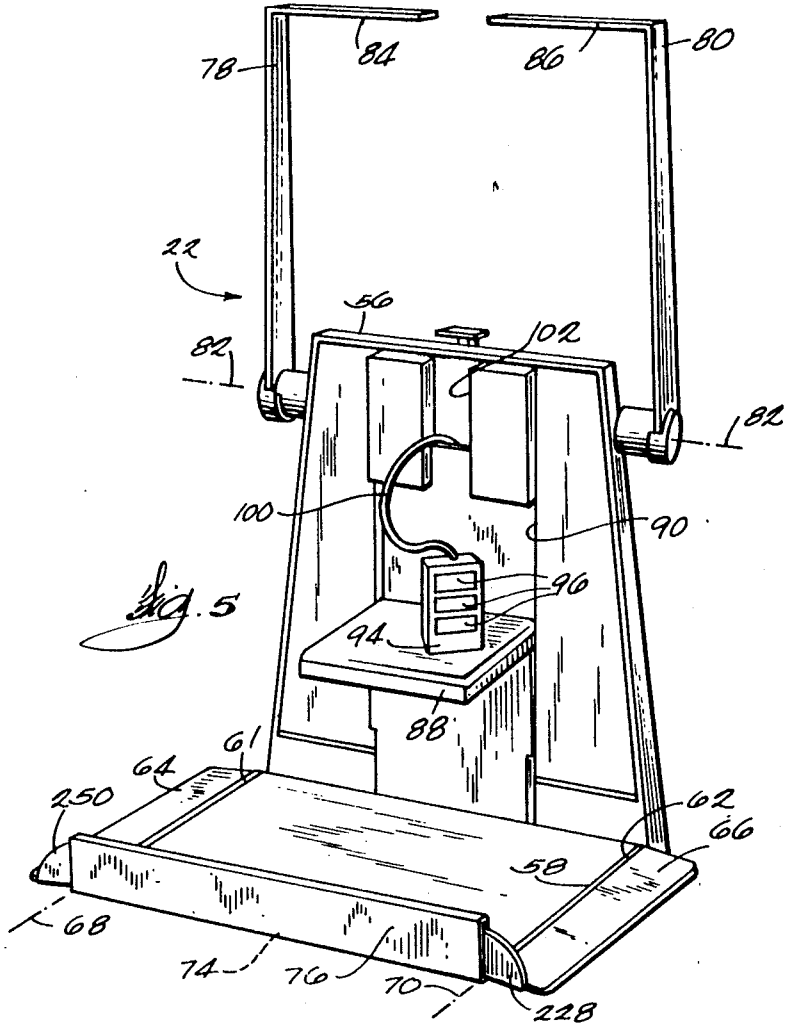
FIG. 5 is another perspective view of the passenger lift platform illustrated in FIG. 4.
Figure 4:
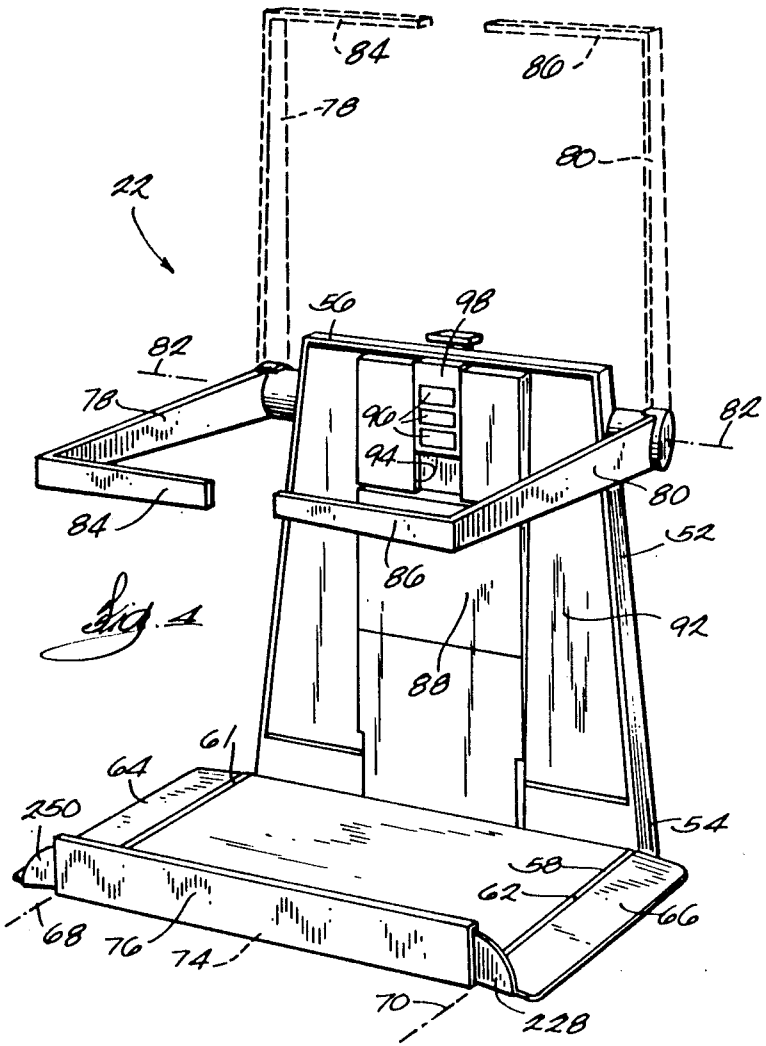
FIG. 4 is a perspective view of a passenger lift platform constructed in accordance with one aspect of the invention.

Referring to FIGS. 4 and 5, the passenger lift platform 22 includes a substantially planar vertical housing 52 having a lower end 54 and an upper end 56 of somewhat lesser width than the lower end 54, giving the vertical housing 52 a generally trapezoidal shape. Adjacent the lower end 54, the passenger lift platform 22 includes a generally planar lower platform 58 having a load supporting surface dimensioned to support thereon a wheelchair-bound passenger.

The lower platform 58 is of generally rectangular shape and is pivotally joined along one edge 60 to the lower end 54 of the vertical housing 52 for movement between a raised position, wherein the lower platform 58 is substantially parallel to the vertical housing 52, and a lowered position, wherein the platform 58 extends substantially perpendicularly from the vertical housing 52.

At each of its right and left ends 61 and 62, the lower platform 58 is provided with a movable end flap or ramp 64 and 66 pivotable around an axis 68 and 70 extending across the width of the platform. Each of the end flaps or ramps 64 and 66 is movable between a lowered position, wherein each flap rests against the floor 72 and forms a ramp to facilitate rolling movement of a wheelchair onto the lower platform 58, and a raised position wherein each flap extends substantially perpendicularly upwardly from the platform to form a barrier for preventing a wheelchair from rolling off the ends of the platform.

Along its edge 74 opposite the vertical housing, the lower platform 58 is provided with a movable edge flap or ramp 76 pivotable between a lowered position, wherein the flap or ramp 76 is substantially co-planar with the lower platform 58, and a raised position, wherein the edge flap 76 extends substantially vertically upwardly from the lower platform 58.

Adjacent the upper end 56 of the vertical housing 52, the passenger lift platform 22 is provided with a pair of elongate right and left guard arms 78 and 80 mounted opposite one another on opposite sides of the vertical housing 52. Each of the guard arms 78 and 80 is independently movable around a horizontal axis 82 extending through the upper end 56 of the vertical housing 52 between a raised position, wherein the arm extends upwardly from the vertical housing, and a lowered position, wherein the arm extends substantially perpendicularly outwardly from the vertical housing.

The distal end of each guard arm is provided with an inwardly directed right angle bend 84 and 86 such that a rigid, substantially rectangular, outer perimeter is formed by the arms in conjunction with the vertical housing 52 when both arms are in the lowered position. The vertical distance between the lowered arms and the lower platform 58 is such that the rigid perimeter formed by the lowered arms effectively forms a guardrail to help retain the passenger on the passenger lift platform 22 during transport. When the arms 78 and 80 are moved to the raised position, and the platform end flaps 60 and 62 lowered, movement of the passenger either onto or off of the lower platform 58 can be accomplished.

To conserve space and avoid interfering with ordinary use of the stairway 12, both the guard arms 78 and 80 and the pivotable lower platform 58 are moved to their respective raised positions when the stairway lift mechanism 10 is standing idle. This has the effect of reducing the overall thickness of the passenger lift platform 22 and thereby decreases the extent to which the passenger lift platform projects into the path of the stairway when the lift mechanism is not in use.

Figure 22:
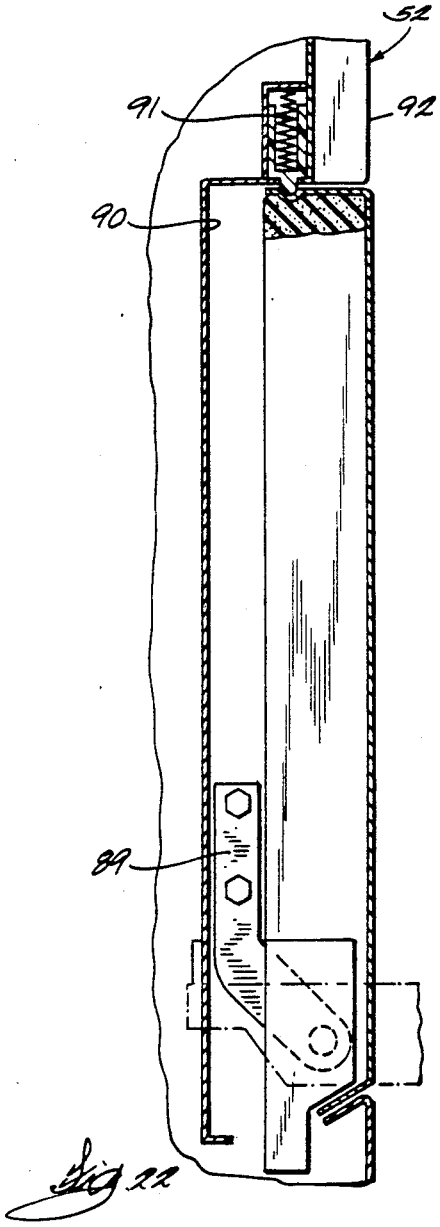
FIG. 22 is a cross-sectional view of a passenger seat assembly as utilized in the passenger lift platform.

To provide the capability of carrying handicapped passengers who are not confined to a wheelchair, the passenger lift platform 22 is provided with a passenger seat 88 pivotably mounted by means of pivotable brackets 89 (FIG. 22) to the vertical housing 52. When not in use, the pivotable seat 88 is received in a recess 90 formed in the front panel 92 of the vertical housing and is retained in a substantially vertical position by means of a spring-loaded plunger retainer mechanism 91. When needed, the seat 88 can be lowered from a storage position, as shown in FIG. 22, to a substantially horizontal position as shown in FIG. 5.

To provide operator control of the stairway lift mechanism 10, the passenger lift platform 22 is also provided with a user control panel 94 having a plurality of user-actuable push-button controls 96. To facilitate simple actuation of the controls by passengers whose mobility may be severely limited, each of the push buttons is relatively large and easily depressed.

Sometimes, as in the case where an attendant accompanies the handicapped person, someone other than the passenger will want to control the operation of the stairway lift mechanism 10. To permit user control of the stairway lift mechanism by persons other than the handicapped passenger, the control panel 94, together with the control buttons 96, is mounted on a removable control housing 98 interconnected with the vertical housing by means of an elongate flexible electrical cable 100. This permits the control panel to be held and actuated by an attendant accompanying the handicapped passenger as the attendant walks alongside the passenger lift platform 22 while the passenger is transported up or down the stairway 12. During normal use, the control panel 94 is received in a recess 102 formed in the front panel 92 of the vertical housing 52 above the movable seat 88 where it can be reached by the handicapped passenger.

Referring to FIGS. 6, 7, 8 and 9, the vertical housing 52 of the passenger lift platform 22 includes a pair of inwardly tapering side panels 104 and 106 extending between the upper and lower ends 56 and 54, and a pair of substantially parallel inner vertical support members or columns 108 and 110 spaced inwardly of the side panels. A parallel pair of vertically spaced, substantially horizontal, upper and lower cross beams 112 and 114 are mounted between the inner vertical support members 108 and 110. Front and rear panels 92 and 116 are mounted on the front and rear of the passenger lift platform 22.

The left guard arm 80 is pivotally mounted to the vertical housing 52 of the passenger lift platform 22 by means of an elongate pivot shaft 118 extending through, and journaled for rotation relative to, both the left side panel 104 and the left inner support column 108. A similarly mounted right arm pivot shaft 120 is provided for pivotally supporting the right guard arm 78. Each of the pivot shafts 118 and 120 includes an inner end 122 and an outwardly projecting portion 124 on which the guard arm 78 or 80 is mounted.

As illustrated, the inner ends 122 of the left and right arm pivot shafts 118 and 120 extend inwardly of the left and right side inner support columns 108 and 110 and respectively. To raise and lower the right and left arms 78 and 80, a sprocket 126 is mounted to the inner end 122 of each pivot shaft 118 and 120 and a bi-directionally movable drive chain 128 is arranged to engage the sprocket 126. One end 130 of the drive chain 128 is connected to the rod end 132 of a hydraulic or pneumatic actuating cylinder 134 fixedly mounted to the right side inner support column 110 below the pivot shaft 118 or 120. The other end 136 of the chain 128 is looped over the sprocket 126 and is connected to one end of a coil spring 138, the other end of which is also fixedly attached to the left or right side inner support column 110. Preferably, the length of the chain 128 is such that when the piston rod of the actuating cylinder 134 is fully retracted as shown in FIG. 8, the coil spring 138 is stretched.

Figure 8:
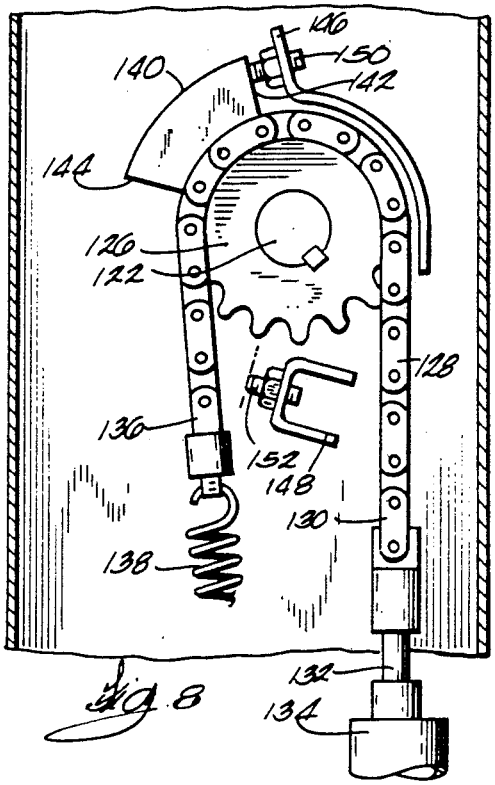
FIG. 8 is a cross-sectional view taken along line 8—8 in FIG. 6 and showing in detail a guard arm actuating mechanism as utilized in the passenger lift platform.

In operation, retraction of the actuating cylinder rod 132 causes the sprocket 126 and right arm pivot shaft 120 to rotate in a clockwise direction, as viewed in FIG. 8, and the right arm 78 to rise from a horizontal to a substantially vertical position. Similarly, when the actuating cylinder 134 is extended, the now stretched coil spring 138 contracts, pulling the chain 128 behind it and causing the right arm pivot shaft 120 to rotate in the opposite direction. Because the arm 78 is moved from the raised position to the lowered position through action of the stretched coil spring 138, no substantial force other than that provided by the spring 138 is available for lowering the arm 78. This limits the maximum downward force that can be exerted by the arm as it is being lowered and serves to avoid personal injury in the event the arm inadvertently lowers onto a part of a passenger's body. During lowering movement of the arm 78, the actuating cylinder 134 serves as a damper to limit the speed with which the arm is lowered.

The limits of arm movement are set by means of an outwardly projecting cog 140 mounted to the inner end of the right arm pivot shaft 120 between the sprocket 126 and the right side inner vertical support column 110. The cog 140 includes a pair of substantially flat faces 142 and 144 extending radially outwardly relative to the right arm pivot shaft 120. A pair of adjustable stops 146 and 148 are also mounted to the right side inner vertical support column 110 adjacent the right arm pivot shaft 120. Each of the stops 146 and 148 includes a threaded post 150 and 152 extending into the path of the cog 140 as the pivot shaft 120 rotates. Maximum upward movement of the arm 78 is limited by one of the flat faces 142 or 144 coming into contact with the post 150 of the upper stop 146, while downward movement of the arm is limited by the other flat face coming into contact with the post 152 of the lower stop 148. Each of the posts is locked in position by means of a threaded nut. By adjusting the position of each post, the final raised and final lowered positions of the arm can be adjusted.

The mechanism for raising and lowering the left arm 80 is substantially similar or identical in construction and operation to the mechanism for raising and lowering the right arm 78.

Figure 7:
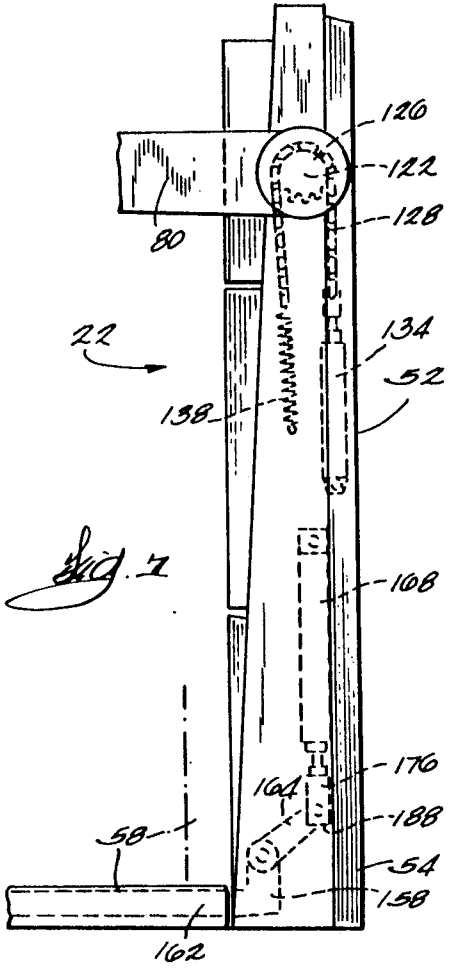
FIG. 7 is a fragmentary side elevational view of the passenger lift platform.
Figure 6:
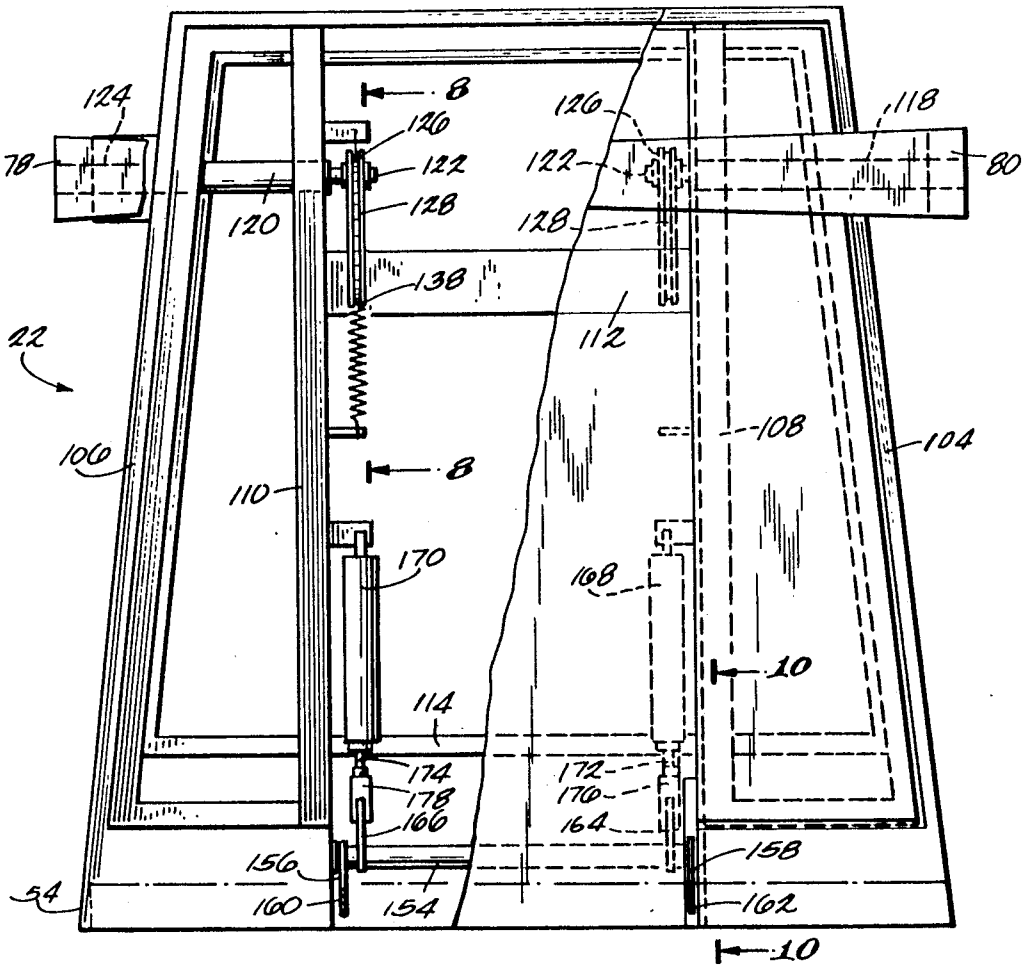
FIG. 6 is a rear elevational view, partially in section, of the passenger lift platform illustrated in FIGS. 4 and 5.
Figure 9:
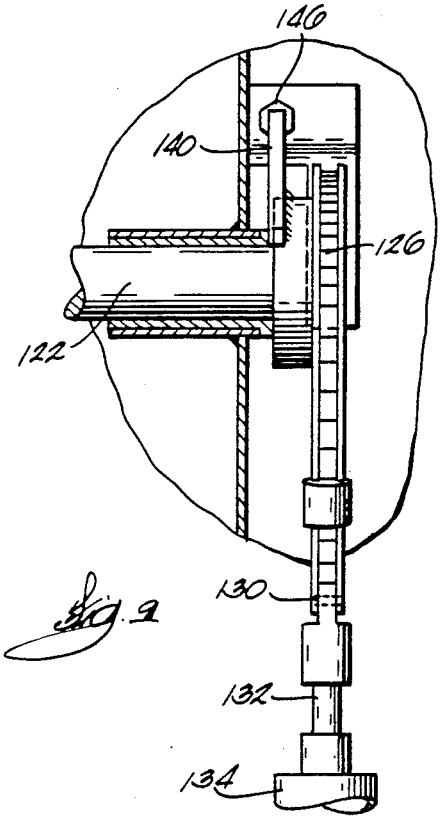
FIG. 9 is a side elevational view, partially in section, of the guard arm actuating mechanism illustrated in FIG. 8.
Figure 11:
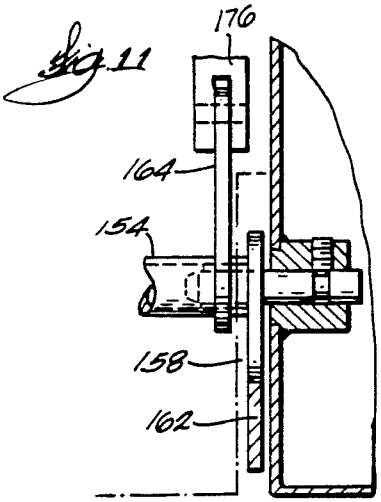
FIG. 11 is a cross-sectional view taken along line 11—11 in FIG. 10.
Figure 10:
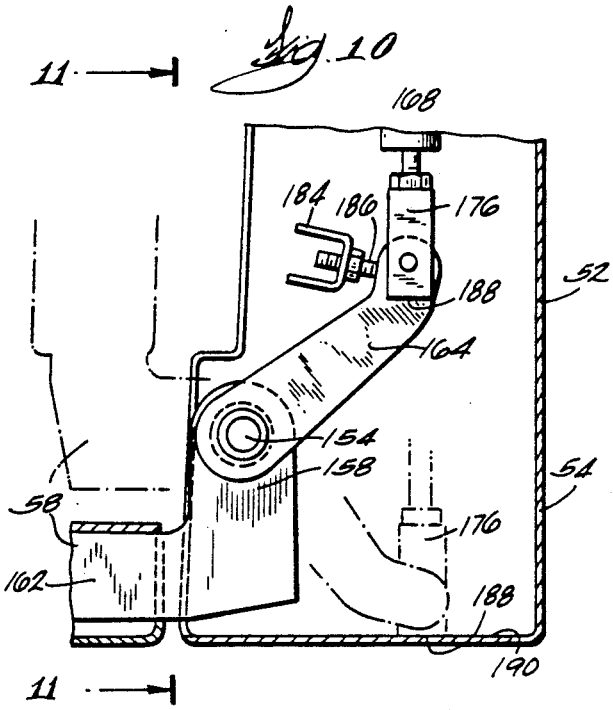
FIG. 10 is a cross-sectional view taken along line 10—10 in FIG. 6 and showing in detail a lower platform raising mechanism incorporated in the passenger lift platform.

Referring to FIGS. 6, 7 and 11, the lower platform 58 is pivotally joined to the lower end 54 of the vertical housing 52 by means of a substantially horizontal platform pivot shaft 154 rotatably mounted between the lower ends of the left and right inner vertical support columns 108 and 110. A pair of right and left platform support arms 156 and 158 extend downwardly and outwardly from each end of the platform pivot shaft 154. The lower platform 58, in turn, is fixedly connected to the outwardly projecting portions 160 and 162 of the right and left platform support arms 156 and 158. In addition to the platform support arms, a pair of left and right crank arms 164 and 166 are also fixedly attached adjacent opposite ends of the platform pivot shaft 154. As best seen in FIGS. 7 and 10, each of the crank arms 164 and 166 extends radially outwardly from the platform pivot shaft 154 into the interior of the vertical housing 52.

The lower platform 58 is raised and lowered by means of a pair of hydraulic or pneumatic actuating cylinders 168 and 170 mounted substantially vertically alongside the left and right inner support columns 108 and 110. The upper end of each actuating cylinder 168 and 170 is pivotally coupled to the adjacent inner support column 108 or 110, while the piston rods 172 and 174 of the cylinders 168 and 170 are respectively coupled to the outermost ends of the crank arms 164 and 166. The piston rod of each actuating cylinder is coupled to its respective crank arm by means of a clevis assembly 176 and 178 coupled to the end of each crank arm 164 and 166 for rotation around a pivot 180 and 182. Extension of the piston rods upon actuation of the cylinders 168 and 170 causes downward movement of the respective crank arms 164 and 166 resulting in rotation of the platform pivot shaft 154 in a clockwise direction as viewed in FIG. 10. This, in turn, results in movement of the lower platform 58 from the horizontal lowered position to the substantially vertical raised position.

The lowered position of the lower platform 58 is fixed by means of an adjustable stop 184 mounted within the vertical housing 52 and having a threaded post 186 positioned so as to engage the end of the left-hand crank arm 164 when the left actuating cylinder 168 is substantially fully retracted. A similar stop (not shown) is provided for contacting the right-hand crank arm 166 when the right-hand cylinder 170 is at or near its fully retracted position. The raised position of the lower platform 58 is limited by means of the lowermost end 188 of the clevis 176 coming into contact with the interior bottom wall 190 of the vertical housing 52. To this end, the lowermost end 188 of the clevis 176 is substantially flat and the crank arm 164 includes a dog leg such that only the lowermost end of the clevis 176 contacts the bottom wall when the actuating cylinder 168 is fully extended.

Figure 12:
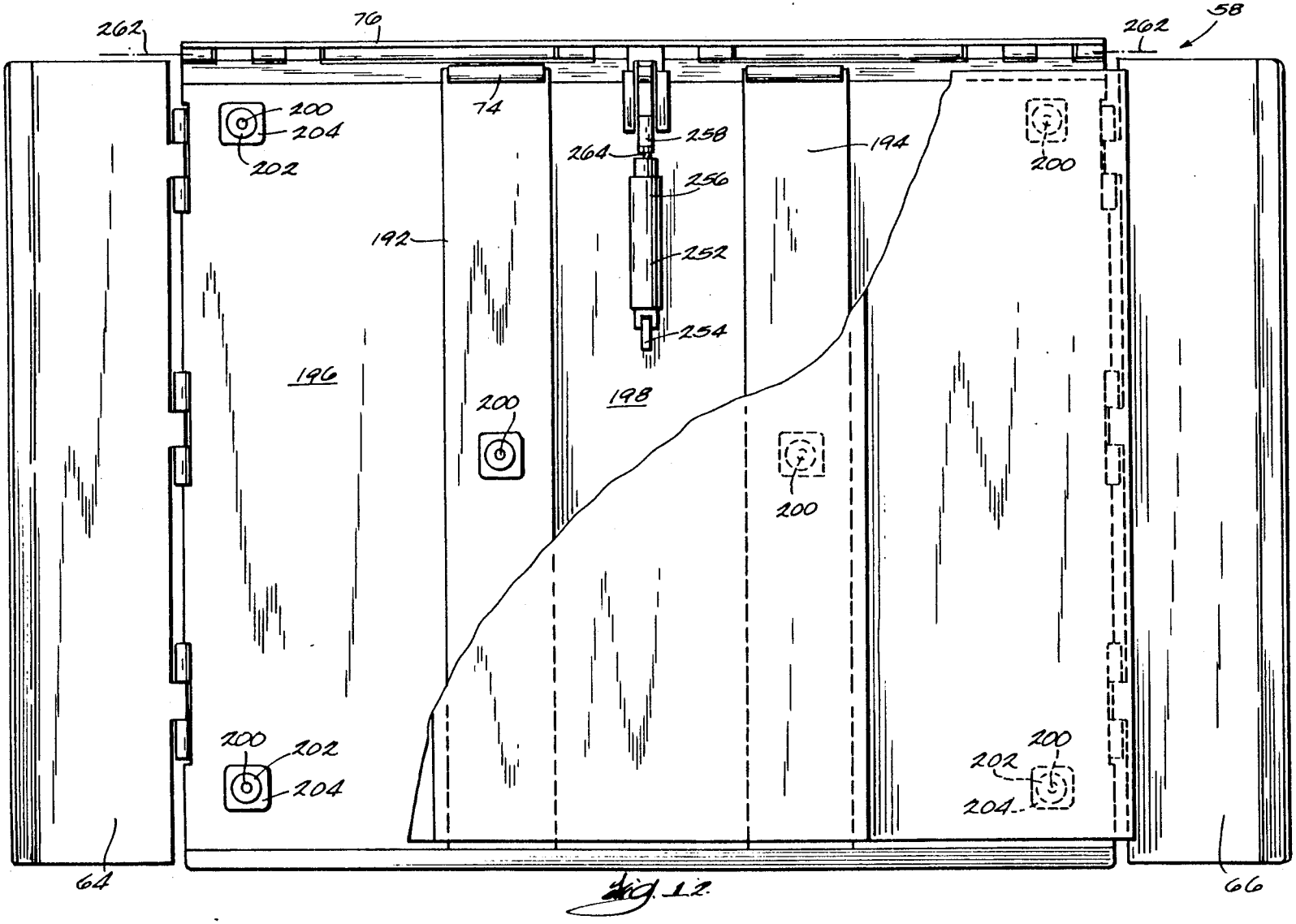
FIG. 12 is a bottom plan view, partially in section, of a lower platform assembly utilized in the passenger lift platform illustrated in FIG. 6.

The construction of the lower platform 58 itself is best illustrated in FIGS. 12 through 16. Referring to FIG. 12, the lower platform 58 comprises a generally rectangular, planar structure dimensioned to support thereon a wheelchair. The lower platform 58 includes a pair of substantially parallel, spaced, lateral internal frame members 192 and 194 to which the outwardly extending portions 160 and 162 of the platform support arms 156 and 158 are fixedly attached. Each of the internal support members 192 and 194 preferably comprises a rigid hollow member of substantially rectangular cross-section formed of steel or some other such rigid, durable material. A substantially rectangular upper cover member or panel 196 is positioned over the lateral support members 192 and 194 to form a rigid, durable upper surface for carrying the passenger. A similar, lower cover member or panel 198 is positioned beneath the upper cover panel 196 on the opposite side of each of the support members 192 and 194.

The lower cover panel 198 is mounted to the underside of the lower platform 58 by means of a plurality of fasteners 200. Each fastener 200 extends through a resilient member 202, such as a section of rubber or a coil spring, so that the lower cover panel 198 "floats" relative to the lower platform 58 and so that limited vertical movement of the lower cover panel 198 relative to the lower platform 58 is permitted. A plurality of electrical switch elements 204, responsive to movement of the lower cover panel 198 relative to the lower platform 58, are positioned between the lower cover panel and the internal structure of the lower platform and are electrically coupled to the electrical control circuitry within the passenger lift platform 22. If an object on the stairway 12 is encountered during movement of the passenger lift platform 22, the lower cover panel 198 is deflected upwardly, actuating one or more of the switches 204 and signaling the system 10 to take appropriate action such as stopping the lift platform 22. This "floating" arrangement renders substantially the entire lower cover panel 198 sensitive to obstructions and permits the use of relatively few switches 204.

Figure 15:
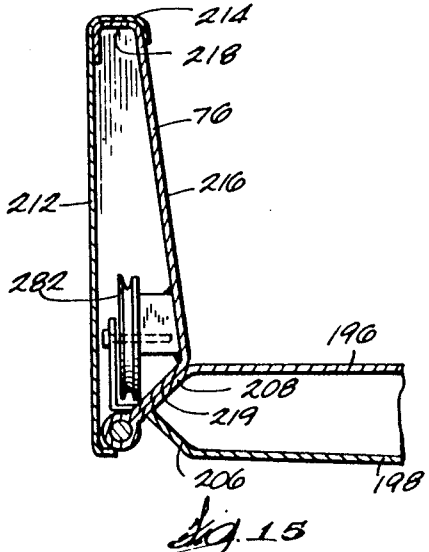
FIG. 15 is a fragmentary cross-sectional view taken along line 15—15 in FIG. 14.
Figure 13:
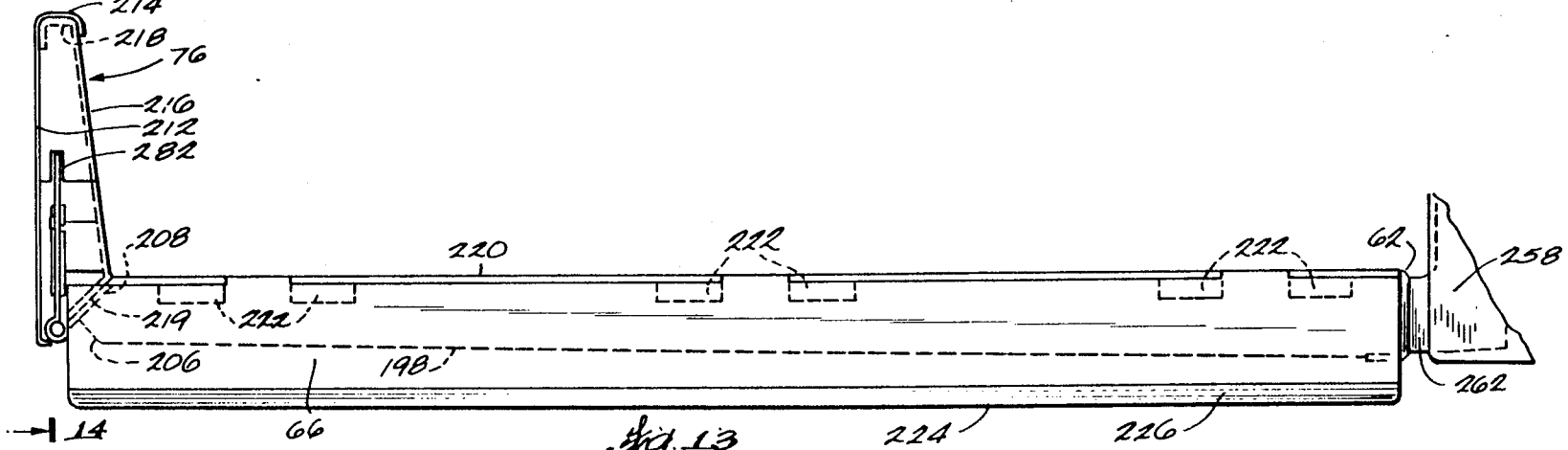
FIG. 13 is a side elevational view, partially in section, of the lower platform assembly illustrated in FIG. 12.

As best illustrated in FIGS. 13 and 15, the outermost edge 206 of the lower panel 198 is turned upwardly while the outermost edge 208 of the upper panel 196 is turned downwardly to meet the upwardly turned edge of the lower panel 198. As further illustrated, the outermost edge 208 of the upper panel 196 continues beyond the edge 206 of the lower panel 198 to permit the formation of a plurality of hinge elements 210 along the outermost edge 206 of the lower panel 198.

The edge flap 76 comprises a hollow, substantially rectangular, planar member dimensioned to extend along the outer edge 74 of the lower Platform 58. Preferably, the edge flap 76 is formed of the same material as the lower platform 58 and includes a lower panel 212 having an upwardly turned peripheral edge 214 and an upper panel 216 having a downwardly turned peripheral edge 218 dimensioned to engage the upwardly turned edge 214 of the lower panel 212. Preferably the upper panel 216 is dimensioned so that the cross-sectional shape of the edge flap 76 tapers toward the outermost peripheral edge 214 and such that a downwardly turned edge or bevel 219 is formed alongside the edge of the flap immediately adjacent the lower panel 58. The bevel 219 thus formed is preferably dimensioned so that the bevel engages the downwardly turned peripheral edge 208 of the upper cover panel 196 when the edge flap 76 extends substantially vertically upwardly from the lower panel as best illustrated in FIGS. 15 and 13. The innermost edge of the edge flap is pivotally connected to the outermost edge 74 of the lower platform 58 by means of the hinges 210 therein provided.

Figure 14:
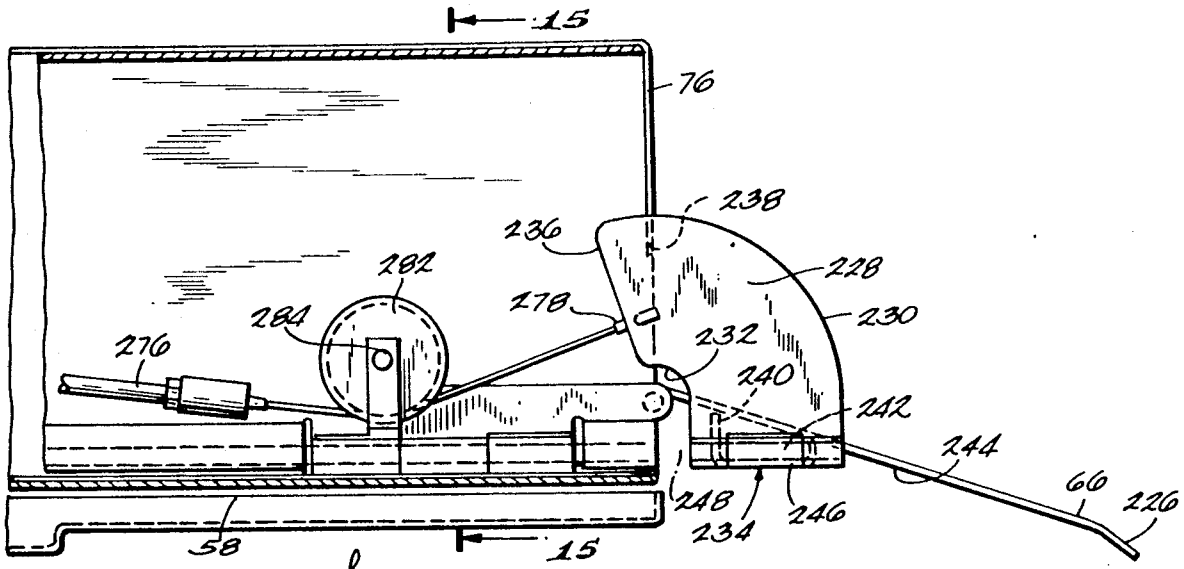
FIG. 14 is a cross-sectional view taken along line 14—14 in FIG. 13.

As best illustrated in FIGS. 13 and 14, the end flap 66 adjacent the left end 62 of the lower platform 58 comprises a generally rectangular panel formed of rigid sheet steel or similar material and pivotally joined along one edge 220 to the end 62 of the lower platform by means of a plurality of hinges 222. The opposite edge 224 of the flap 66 includes a downwardly turned lip 226 for engaging the floor 72 when the end flap 66 is in the lowered positions illustrated in FIGS. 13 and 14. When so lowered, the end flap 66 provides a convenient ramp for enabling a wheelchair to roll forwardly onto the lower platform 58. The right end flap 64 is similarly constructed and mounted.

Adjacent the juncture of the left end flap 66, the edge flap 76 and the lower platform 58, the passenger lift platform 22 is provided with a gusset Plate 228 having curved outer and inner edges 230 and 232 respectively. The gusset plate 228 includes a lower end 230, which is pivotally coupled to the side edge of the end flap 66 by means of a hinge mechanism 234, and another, or upper end 236 extending into the interior of the edge flap 76 through a slot 238. The hinge mechanism 234 comprises a hinge pin assembly 240, having a hinge pin 242, mounted to the undersurface 244 of the end flap 64 and a hinge collar 246 formed adjacent the lower end 230 of the gusset plate 228 and adapted to surround the hinge pin 242. Preferably, the hinge assembly 240 is configured such that the hinge pin 242 is substantially colinear with the generally horizontal axis 248 around which the edge flap 76 pivots relative to the lower platform 58 such that the edge flap 76, together with the gusset plate 228, can be pivoted relative to the lower platform 58 while the end flap 66 remains in the lowered position illustrated in FIGS. 13 and 14. A similarly constructed and mounted gusset plate 250 is provided adjacent the juncture of the right end flap 64 and the edge flap 76.

When the edge flap 76 is raised as illustrated in FIGS. 13 through 15, the left end flap 66 can be raised toward a substantially vertical position as the gusset plate 228 projects through the slot 238 into the interior of the edge flap 76 It will thus be appreciated that the gusset plate 228 forms a fillet between the adjacent edges of the end and edge flaps when both flaps are in their respective lowered positions and permits the edge and end flaps to be raised from their respective, horizontal, lowered positions to their respective, raised, substantially vertical positions.

Referring to FIG. 12, the edge flap 76 is raised and lowered by means of a pneumatic or hydraulic actuating cylinder 252 positioned between the upper and lower cover panels 196 and 198 of the lower platform 58 and oriented substantially perpendicularly to the outer edge 74 of the lower platform 58. One end of the actuating cylinder 252 is pivotally connected to the undersurface 254 of the upper cover panel 196 and the other end 256 of the cylinder 252 is coupled through a bent link arm 258 to the edge flap 76. The link arm 258 is pivotable around an axis extending substantially colinearly with the pivot axis 262 of the hinges joining the edge flap 76 to the lower platform 258 such that extension of the actuating cylinder's rod 264 causes the edge flap 76 to rotate from a substantially horizontal position to the raised, vertical position indicated in FIGS. 13, 14 and 15.

The left end flap 66 is raised and lowered relative to the lower platform 58 by means of an additional actuating cylinder 266 positioned between the upper and lower panels 212 and 216 of the edge flap 76. One end 268 of the actuating cylinder 266 is coupled to the undersurface 270 of the edge flap upper panel 212, and the rod end 272 of the actuating cylinder 266 is coupled to one end 274 of a flexible, non-stretchable actuating cable 276. The other end 278 of the actuating cable 276 is coupled to the inner end 236 of the end flap gusset 228 and is reeved under a rotatable idler wheel 282 which, in turn, is mounted within the edge flap 76 for rotation around an axis 284 extending substantially perpendicularly to the lower panel 216 of the edge flap 76. Extension of the actuating cylinder s cylinder rod 286 permits the gusset 228 to extend from the edge flap 76 and allows the end flap 64 to fall, under its own weight, to the lowered position shown in FIGS. 13 and 14. Retraction of the cylinder rod 286 pulls the gusset 228 into the interior of the edge flap 76 to raise the end flap 64 to the substantially vertical raised position. A similar actuating cylinder, actuating cable and idler wheel are provided for raising and lowering the opposite right end flap 64.

The Motor Drive Unit

Figure 18:
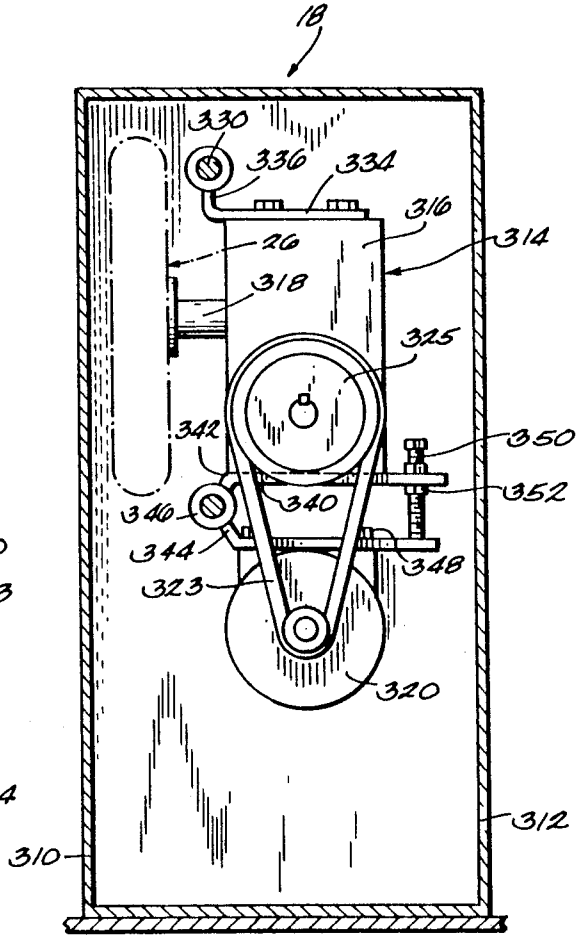
FIG. 18 is a cross-sectional view taken along line 18—18 in FIG. 17.
Figure 17:
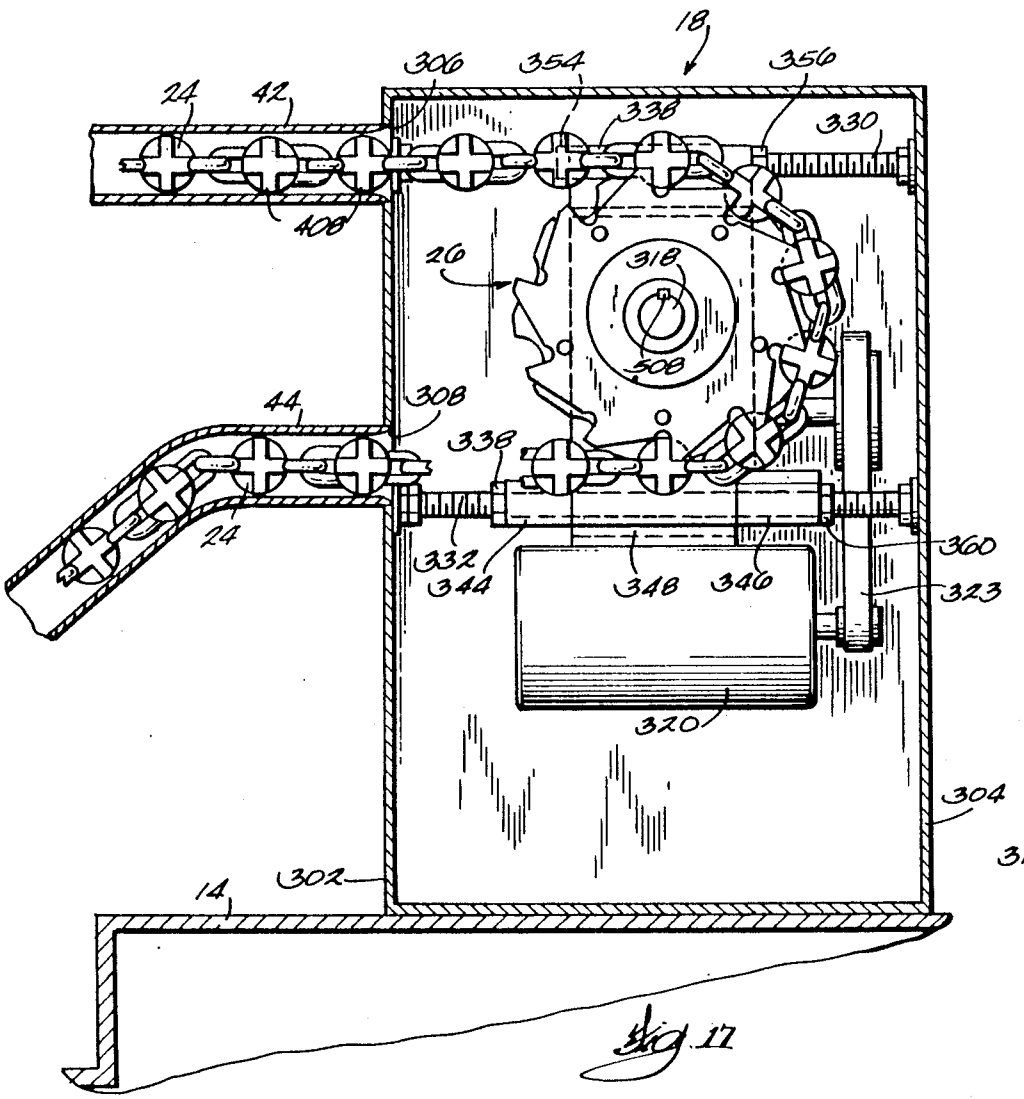
FIG. 17 is a cross-sectional view taken along line 17—17 in FIG. 2.
Figure 16:
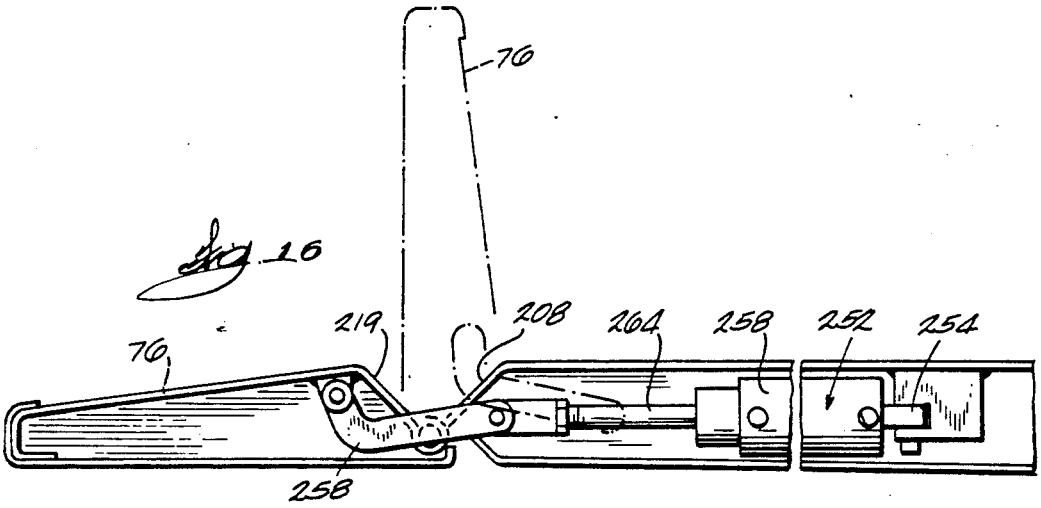
FIG. 16 is a fragmentary cross-sectional view taken along line 16—16 in FIG. 12.

The motor drive unit 18 is illustrated in FIGS. 17 and 18. As shown, the motor drive unit includes a generally rectangular housing 300 having one or more openings for permitting the drive chain 24 to enter and exit the housing 300. In the embodiment illustrated, the motor drive unit housing 300 includes a pair of substantially vertical, relatively narrow, spaced side panels 302 and 304, one of which, 302, includes a pair of vertically spaced apertures 306 and 308 for receiving the ends 42 and 44 of the rail assembly 20 and for permitting the drive chain 24 to enter and exit the housing 300. A pair of spaced, substantially parallel, front and rear cover panels 310 and 312 are mounted between the side panels 302 and 304.

Within the housing 300, the motor drive unit 18 further includes a drive assembly 314 comprising a gear box 316 and a substantially horizontal rotatable shaft 318 extending outwardly from the gear box 316 substantially perpendicularly to the front and rear housing panels 310 and 312. The sprocket 26 is mounted on the rotatable shaft 318 and is oriented so as to lie substantially in the plane defined by the upper and lower rails 42 and 44 of the rail assembly 20. A motor 320, for driving the gear box 316, is mounted to a motor support platform 322 located adjacent the lower end of the gear box 316. Drive power to the gear box 316 is coupled from the motor 320, through a belt 323 and pulley 325, to one end of an input drive shaft 328 extending outwardly from the gear box 316 below, and substantially perpendicularly to, the rotatable shaft 318. Within the gear box 316, appropriate gear elements (not shown) translate rotation of the input drive shaft 328 into rotation of the rotatable shaft 318.

To support the drive assembly 314 within the housing 300, the motor drive unit 18 further includes a pair of vertically spaced, substantially horizontal, parallel, upper and lower threaded shafts 330 and 332 mounted between the housing side panels 302 and 304. As best seen in FIG. 18, the gear box 316 includes a horizontal top plate 334 having an upwardly turned lip 336 along one edge and a substantially horizontal circular collar 338 formed at the distal end of the lip dimensioned to encircle the upper threaded shaft 330. A bottom plate 340, having a downwardly turned lip 342 and a pair of cylindrical collars 344 and 346 dimensioned to encircle the lower threaded shaft 332, is mounted to the lower end of the gear box 316 and includes an outwardly projecting, substantially horizontal flange portion 343.

The motor support platform 322 comprises a substantially horizontal plate having an upwardly extending tab 344 and a cylindrical collar 348 dimensioned to encircle the lower threaded shaft 332 between the collars 344 and 346 of the gear box bottom plate 340. This permits the motor support platform 322 to pivot around the lower threaded shaft 322. The motor 320 is secured to the undersurface of the motor support platform 322 by means of a plurality of bolts 348, and the tension of the belt 323 between the pulley 325 and the motor 320 serves to fix the position of the motor support platform 322 and the motor 320 relative to the gear box 316. Belt tension can be adjusted by means of a threaded tensioning bolt 350 extending through the flange 343 of the gear box bottom plate 340 and engaging the upper surface of the motor support platform 322. A locking nut 352 is preferably mounted on the threaded shank portion of the tensioning bolt 350 to fix the vertical position of the tensioning bolt 350 relative to the gear box bottom plate 340 when the desired belt tension is achieved.

To permit adjustment of the tension of the chain 24 within the rail assembly 20, the position of the gear box 316 with respect to the threaded shafts 330 and 332, the housing 300, and the ends of the rail assembly 42 and 44, is adjustable. To this end, both the upper and lower threaded shafts 330 and 332, together with the circular collars 338, 344 and 346 mounting the gear box 316 to the threaded shafts, permit limited movement of the drive assembly 314 in a direction substantially perpendicular to the rotatable shaft 318. This has the effect of moving the sprocket 26 toward or away from the ends of the rail assembly with the further effect that chain tension can thereby be reduced or increased.

As best seen in FIG. 17, a pair of threaded nuts 354 and 356 are disposed on the upper threaded shaft 330 on opposite sides of the gear box 316, while an additional pair of threaded nuts 358 and 360 threadedly engage the lower threaded shaft 332 on opposite sides of the gear box 316. By adjusting the position of the threaded nuts 354 and 358 on the side of the gear box 316 nearest the ends 42 and 44 of the rail assembly 20, the gear box 316 can be driven away from the rail assembly ends so as to increase chain tension, or can be permitted to more closely approach the rail assembly and thus decrease tension. Once the desired chain tension is achieved, the opposite nuts 356 and 360 can be brought to bear against the opposite side of the gear box 316 so as to fix the position of the gear box within the motor drive housing 300.

The Flexible Drive Member

Figure 19:
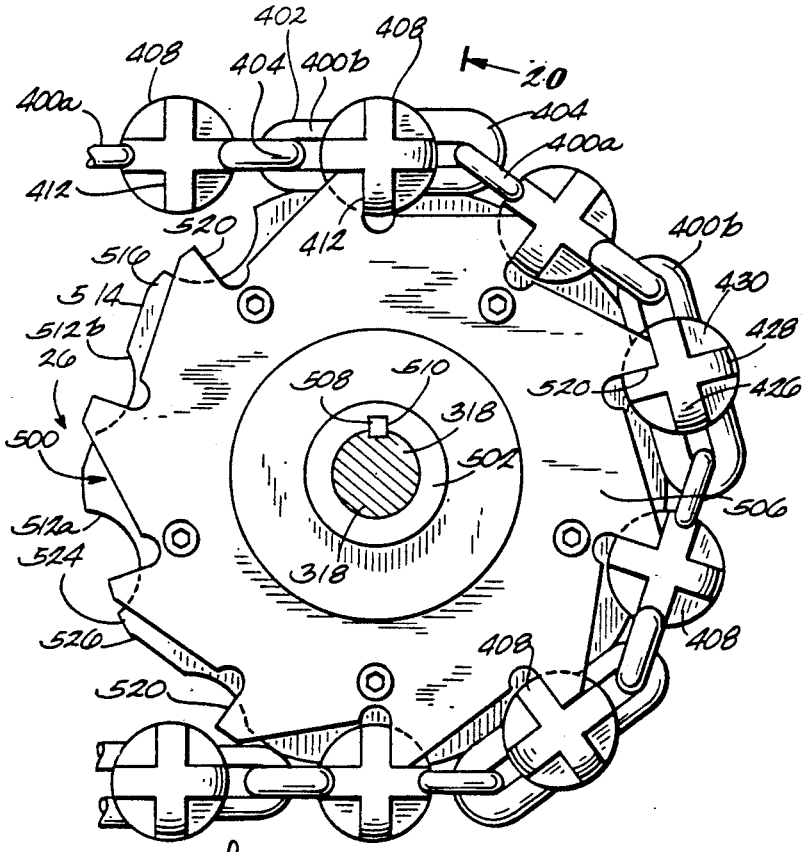
FIG. 19 is a side elevational view of a sprocket and chain assembly as utilized in the motor drive unit illustrated in FIGS. 17 and 18.
Figure 21:
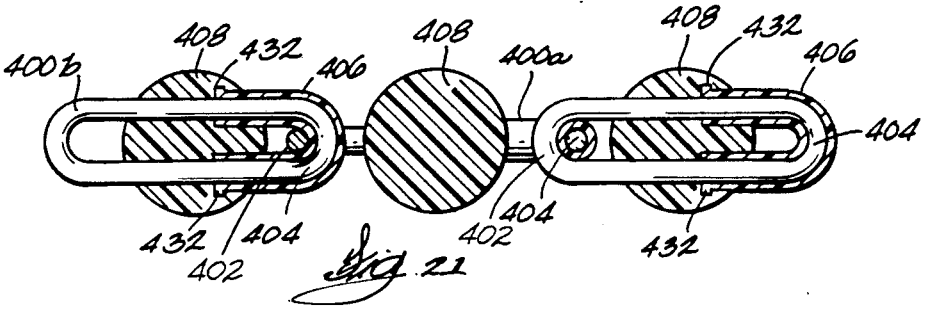
FIG. 21 is a cross-sectional view useful in understanding the construction of the chain illustrated in FIGS. 19 and 20.

Referring to FIGS. 19 and 21, the flexible drive member or chain 24 comprises a plurality of elongate, closed-loop, metal links 400*a* and 400*b* each having opposite U-shaped leading and trailing ends 402 and 404. The links 400 are joined in interlocking relationship such that the trailing end 404 of one link interlocks with the leading end 402 of a following link. As illustrated, adjacent links are rotated substantially 90° around their alternate links 400*a* are oriented in a substantially horizontal plane, while intermediate links 400*b* are oriented in a substantially vertical plane.

As further illustrated, at least one end of each link is coated with a non-metallic coating 406 such that metal to metal contact between the interlocking ends of adjacent links is substantially avoided. Preferably, the non-metallic coating 406 is formed of a moldable plastic, such as nylon, or some other such durable, moldable, non-metallic material.

To help transfer externally applied driving forces to the drive chain 24 as well as assure quiet running of the drive chain within the interior of the rail assembly 20, the drive chain 24 further includes a plurality of spherical rigid members 408 molded onto each of the links 400 so as to surround a portion of each link between its leading and trailing ends 402 and 404. Preferably, each spherical rigid member 408 is formed of the same non-metallic material used to form the non-metallic coating 406 over the link ends. In addition, each spherical rigid member 408 is preferably dimensioned such that each link 400 of the chain 24 is supported within the interior of the rail assembly 20 without any metallic portion of the link coming into contact with the interior of the rail assembly.

As noted, each of the spherical rigid members 408 serves as a means by which driving forces can be transmitted to the chain 24. To this end, a plurality of side-by-side notches 410 and 412, each defining a substantially flat thrust receiving surface, are formed in each of the spherical rigid members 408. As illustrated, eight such notches 410, 412, 414, 416, 418, 420, 422 and 424, each having the general shape of one quadrant of a hemisphere, are formed in each of the spherical rigid members 408 and are regularly spaced from one another such that each spherical member has the general form of three mutually perpendicular circular discs 426, 428 and 430 having a common center. Accordingly, even though adjacent links are rotated 90° with respect to each other, the spherical rigid members 408 molded onto adjacent links will, nevertheless, appear substantially identical, i.e., each spherical rigid member will appear to have the same orientation.

FIG. 21 illustrates the molding sequence utilized during manufacture of the chain. First, the non-metallic coating 406 is molded onto the trailing end 404 of each link. Preferably, the coating 406 is of uniform thickness except for an outwardly turned lip 432 formed where the coating terminates adjacent the middle of each link. Next, the rigid spherical member 408 is molded onto the midportion of each link between the leading and trailing ends 404 and 406 such that at least part of each coated trailing end is embedded within the spherical member and such that no metal portion of the link is exposed between the spherical member and the trailing end of each link. The outwardly extending lips 432 serve to help anchor the spherical members 408 to the non-metallic coating 406, and to the links 400, and helps transfer driving forces from the spherical members 408 to the links 400.

The Drive Sprocket

Figure 20:
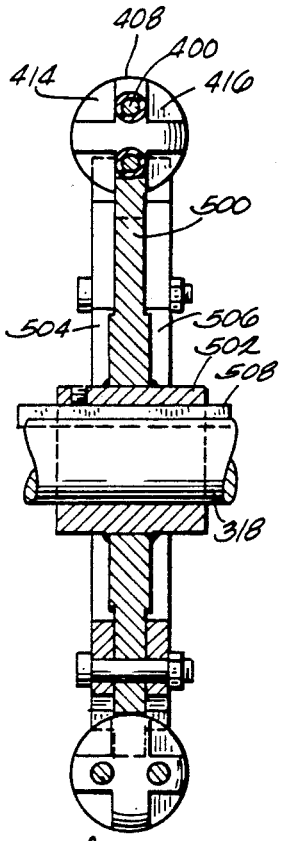
FIG. 20 is a cross-sectional view taken along line 20—20 in FIG. 19.

Referring particularly to FIG. 19 and 20, the drive sprocket 26 comprises a generally circular, planar structure adapted to be mounted on, and co-rotatable with the rotatable shaft 318 of the motor drive unit 18. The drive sprocket 26 generally includes a center plate 500 having a central hub 502 for receiving therethrough the rotatable shaft 318, and a pair of side plates 504 and 506 mounted on opposite sides of the center plate 500 substantially concentrically with the hub 502. Preferably, each of the side plates 504 and 506 and center plate 500 is formed of steel or some other such rigid, durable material. The center plate 500 is locked to the rotatable shaft 318 by means of a square sectioned key 508 and keyway 510 along the juncture between the hub 502 and the shaft 318.

As best illustrated in FIG. 19, the outer periphery of the center plate 500 is adapted to engage the substantially circular outer peripheries of the spherical members 408 associated with a plurality of chain links 400 as the chain 24 is looped around the sprocket 26. To this end, the outer periphery of the center plate 500 includes a plurality of regularly spaced, arcuate depressions 12, each dimensioned to closely receive the outer periphery of the vertically oriented one of the mutually orthogonal disks 426, 428 and 430 associated with each of the chain link spherical members 408. In addition, the outer periphery of the center plate 00 is beveled such that a pair of angled flats 514 and 516 is formed between each of the arcuate depressions 512.

Because adjacent links 400*a* and 400*b* of the chain 24 are rotated 90° relative to each other, the shape and orientation of the bevels in the outer periphery of the center plate 500 between adjacent arcuate depressions 512 is not uniform but, rather, is tailored such that the center plate outer periphery can closely receive the drive chain 24. Thus, alternate ones of the arcuate depressions 512*a* in the outer periphery of the center plate 500 are adapted to receive only those links 400*a* wherein the link orientation is substantially vertical, while alternate intervening ones 512*b* of the arcuate depressions are intended to receive only those links 400*b* which are substantially horizontally oriented. It will be noted that, as illustrated, the lowermost point of each depression 512*b* receiving one of the horizontally oriented links 400*a* is closer to the center of the shaft 318 than is the lowermost point of each depression 512*b* receiving a vertically oriented link 400*b*. Furthermore the flats 514 and 516 formed immediately adjacent each of the depressions 512*a* adapted to receive substantially vertically oriented ones of the links 400*a* are longer than the flats 514 and 516 immediately adjacent the depressions 512*b* adapted to receive the substantially of the links 400*b*.

As further illustrated in FIGS. 19 and 20, the outer peripheries of the side plates 504 and 506 are adapted so as to engage the side-by-side notches 410 and 412, and in particular the thrust receiving surfaces, in each of a plurality of the spherical members 408 formed on a plurality of chain links 400 engaged by the sprocket 26 at any given time. In particular, one of the side plates 504 is arranged to engage one notch 410 in each pair of side-by-side notches in the spherical members engaged by the sprocket, while the other side plate 506 is adapted to engage the other of the side-by-side notches 412. To this end, each of the side plates 504 and 506 is provided with a plurality of teeth 520 each having a substantially radially oriented face 522 and a substantially tangentially 524 oriented face oriented substantially at right angles relative to the radially oriented face 522. The right angle formed at the juncture of each radially oriented and tangentially oriented face is dimensioned to be closely received in one of the notches 410 or 412 formed in a chain link spherical member 408. Between adjacent teeth in each of the side plates 504 and 506, the periphery of the side plate is beveled such that a sloped edge 526 is formed between the trailing end of one tooth and the leading end of the adjacent, following tooth. Again it will be noted that adjacent teeth within each of the side plates 504 and 506 are not identical but, rather, are positioned and dimensioned so as to conform to respective vertically oriented and horizontally oriented links 400*a* and 400*b* of the chain 24.

The Carrier System

The passenger lift platform is mounted for movement along the rail assembly 20 by means of a carrier system 28 illustrated in FIGS. 23–29. The carrier system includes an upper carrier assembly 30 adapted to move along the upper rail 34 of the rail assembly 20 and a lower carrier assembly 31 adapted to move along the lower rail 36 of the rail assembly 20. Both the upper and lower carrier assemblies 30 and 31 are mounted on the rear vertical panel 116 of the passenger lift platform 22 and are each adapted to be pivotable relative to the passenger lift platform 22 so that the passenger lift platform can hang vertically regardless of the relative orientation of the upper and lower rails 34 and 36 and the respective carrier assemblies 30 and 31.

Figure 23:
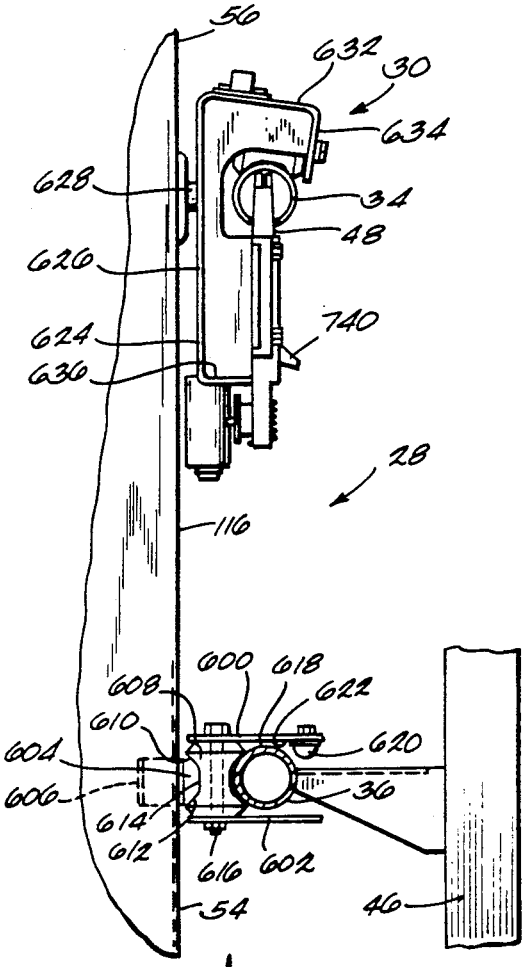
FIG. 23 is a cross-sectional view of the stairway lift mechanism illustrated in FIG. 1 taken along line 23—23 thereof showing in detail structure for supporting the passenger lift platform from a rail.

As best seen in FIG. 23, the lower carrier assembly 31 comprises a pair of spaced, parallel, substantially horizontal upper and lower plates 600 and 602 arranged to straddle the lower rail 36. The upper and lower plates 600 and 602 are each coupled to a substantially horizontal pivot shaft 604 oriented to extend outwardly from the lower rail 36 and into a hollow, cylindrical bushing 606 mounted through the lower crossbeam 114 at the lower end 54 of the passenger lift platform. A substantially vertical roller 608, having opposed frusto-conical sections 610 and 612 separated by a central, substantially cylindrical section 614, is pivotably mounted between the upper and lower plates 600 and 602 for rotation around an axis 616 extending perpendicularly through the upper and lower plates 600 and 602. As illustrated, the roller 608 is dimensioned so as to engage the outer surface 618 of the lower rail 36 and thereby support both the lower carrier 31, and the passenger lift platform 22, for movement along the lower rail 36. A downwardly depending, removable stop member 620 is mounted to the undersurface 622 of the upper plate 600 opposite the vertical roller 608 and serves to prevent inadvertent disengagement of the lower carrier 31 from the lower rail 36.

The upper carrier assembly 30 includes a platform support bracket 624 formed of steel or some other such durable rigid material. The platform support bracket 624 includes a substantially vertical outer face 626 and a substantially horizontal, cylindrical, pivot axis 628 extending horizontally outwardly from the outer face 626. The pivot axis 628 is received in a hollow cylindrical bushing 630 mounted in the upper crossbeam 112 near the upper rear end 56 of the passenger support platform 22 and permits pivotal movement of the upper carrier assembly 30 relative to the passenger support platform 22.

Adjacent the upper end of the vertical outer face 626, the upper carrier assembly 30 is bent toward the upper rail 34 so as to form a downwardly sloping top surface 632 and a downwardly depending flange portion or lip 634 angled inwardly toward the vertical face 626. The bends are dimensioned so that the upper end of the carrier support assembly substantially surrounds the upper surface 635 of the upper rail 34. The lower surface of the vertical face 626 includes an inwardly directed, substantially right-angle bend 636 terminating below the upper rail 34.

Figure 28:
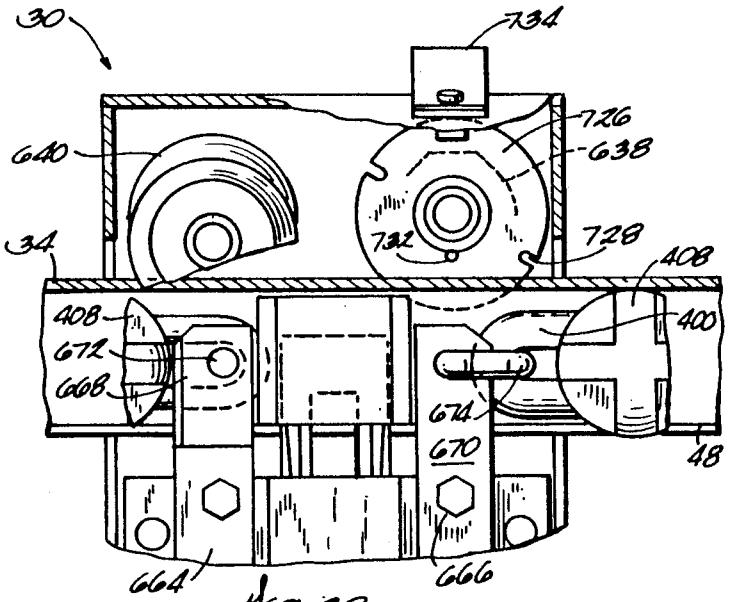
FIG. 28 is a cross-sectional view taken along line 28—28 of FIG. 25.
Figure 26:
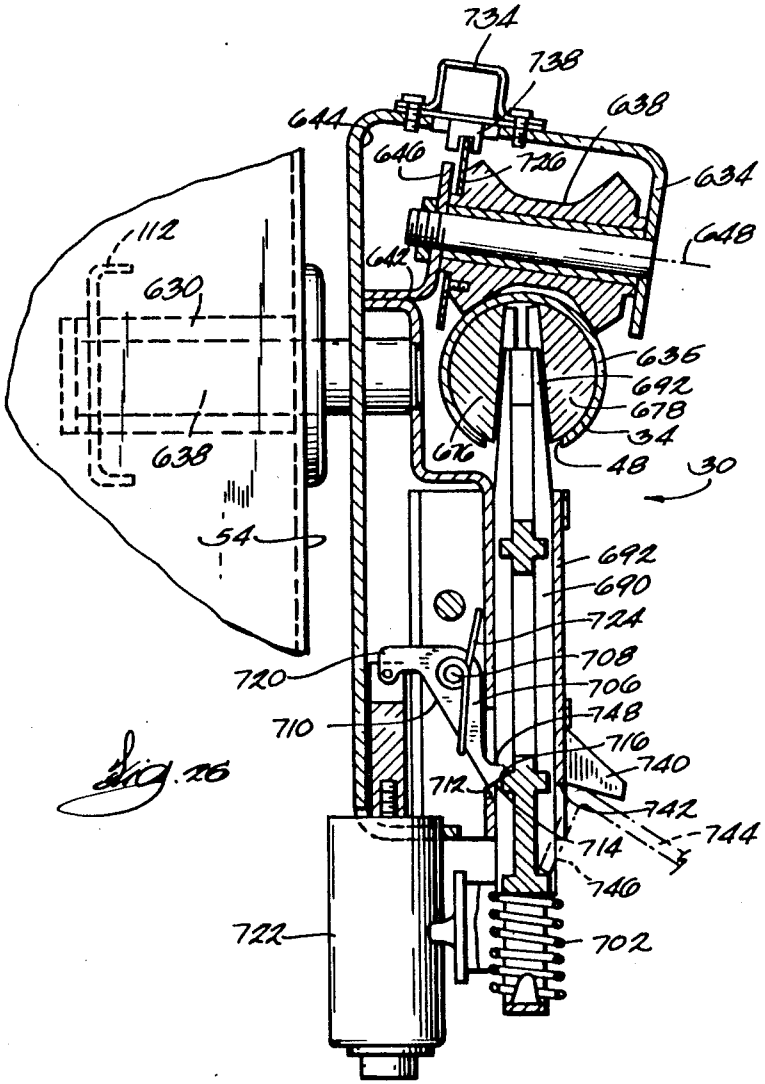
FIG. 26 is a cross-sectional view taken along line 26—26 FIG. 24.

To support the weight of the passenger lift platform 22, the upper carrier assembly 30, as best illustrated in FIGS. 26 and 28, includes a pair of rollers 638 and 640 engaging the upper surface 635 of the upper rail 34. To support the rollers 638 and 640, an inner flange or lip 642 is mounted to the inner surface 644 of the vertical carrier face 626 and includes a generally upwardly extending lip 646 bent at an angle such that the lip 646 is substantially parallel to the downwardly extending lip 634 of the platform support bracket 624. Each of the rollers 638 and 640 is rotatably mounted between the upwardly and downwardly extending lips 646 and 634 and is supported for rotation around an axis 648 sloping downwardly from the passenger lift platform 22 toward the rail assembly 20.

Figure 27:
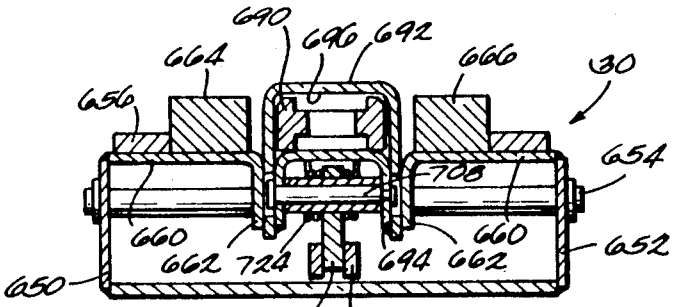
FIG. 27 is another cross-sectional view taken along line 27—27 in FIG. 24.

As illustrated in FIG. 27, the upper carrier assembly further includes a pair of substantially parallel, spaced side panels 650 and 652 connected to one another by means of a longitudinally extending fastener 654 and further includes a pair of spaced, substantially vertical back panels 656 and 658 each of substantially L-shaped cross-section. The back panels 656 and 658 are positioned adjacent the side panels 650 and 652 respectively such that each back panel 656 and 658 includes a portion 660 which is substantially parallel to the front vertical face 626 of the platform support bracket 624 and a portion 662 which is oriented substantially perpendicularly to the front face 626. The back panels 656 and 658 are dimensioned such that a gap exists between the perpendicular portions 662 and are held in place by means of the elongate fastener 654 extending through each of the perpendicular portions 662.

To facilitate bi-directional movement of the passenger lift platform 22 along the rail assembly 20, the upper carrier assembly 30 is adapted to be coupled to the chain 24 within the rail assembly 20. To this end, a pair of spaced, substantially parallel, upwardly extending coupling or drive pins 664 and 666 are rigidly mounted to the back panels 656 and 658 of the upper carrier assembly 30. As best seen in FIG. 28, the uppermost end 668 and 670 of each drive pin 664 and 666 is dimensioned to extend through the slot 48 formed in the undersurface of the upper rail 34 and is adapted to engage an individual link 400 of the chain 24 within the rail assembly 20. In particular, one of the drive pins 664 is coupled to a link forming one end of the chain, while the other drive pin 668 is coupled to the link forming the opposite end of the chain 24. As illustrated in connection with the left hand drive pin 664, the drive pin can be joined to the chain 24 by means of a substantially horizontal pin 672 extending through the closed loop end of the adjacent link 400. Alternatively, as illustrated in connection with the right hand drive pin 666, a short, closed-loop link member 674 extending through the drive pin and through the closed-loop end of a chain link 400 can also be utilized. It will be appreciated that, after coupling, an open gap exists within the upper rail between the upper ends 668 and 670 of the drive pins 664 and 666.

To avoid runaway movement of the passenger lift platform 22 in the event of, for example, a chain failure, brake means are provided for automatically opposing movement of the upper carrier assembly 30 relative to the rail assembly 20 in the event the speed of the upper carrier assembly relative to the rail exceeds a predetermined threshold.

In the illustrated embodiment, the brake mechanism includes a pair of opposed brake members 676 and 678 housed within the upper rail 34 between the ends of the drive pins 664 and 666. As best seen in FIGS. 26 and 29, each of the brake members 676 and 678 is formed of a durable material having a relatively high coefficient of friction, and includes an outer surface 680 shaped and dimensioned to conform to the interior surface 682 of the upper rail 34. Opposite the outer surface 680, each of the brake members 676 and 678 includes a shallow, sharp-cornered depression 684 which, in cooperation with a similar depression 686 formed in the opposite brake member, forms a tapered notch 688 extending between the brake members 676 and 678 when the brake members are positioned opposite one another within the upper rail 34. Braking action is achieved when the opposed brake members are driven outwardly relative to one another within the interior of the upper rail.

To selectively drive the brake members 676 and 678 away from one another and into engagement with the interior surface 682 of the upper rail 34, the brake mechanism further includes a movable wedge member 690 mounted on the platform support bracket between the drive pins 664 and 666. The wedge member 690 includes a tapered upper end 692 dimensioned to extend through the slot 48 in the undersurface of the upper rail 34 and into the tapered notch 688 formed between the opposed brake members 676 and 678. Preferably, the wedge member 690 is formed of a rigid, durable material such as steel.

The wedge member 690 is received within an outer channel member 692 of rectangular cross-section positioned between the back panels 656 and 658. An additional, inner, channel member 694, of rectangular cross-section, is received within the outer channel member 692 and, together with the outer channel member, defines a hollow guide 696 through which the wedge member 690 extends. When it is positioned within the guide 696 thus formed, the wedge member 690 is movable between an extended position, wherein the tapered end 692 of the wedge is driven between the brake members 676 and 678 so as to bias the brake members outwardly into contact with the interior of the upper guide rail 34, and a retracted position, wherein the wedge member does not force the brake members into contact with the guide rail with sufficient force to prevent relative movement between the brake members and the guide rail.

Figure 24:
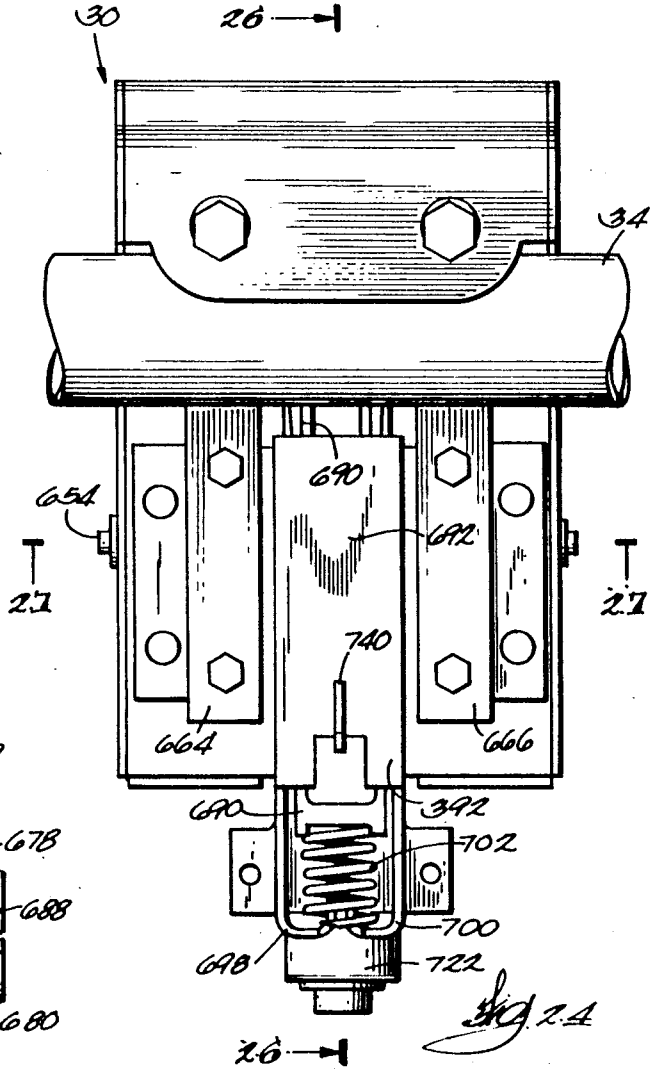
FIG. 24 is a rear elevational view of a carrier for supporting the passenger lift platform for movement along a rail.
Figure 22:
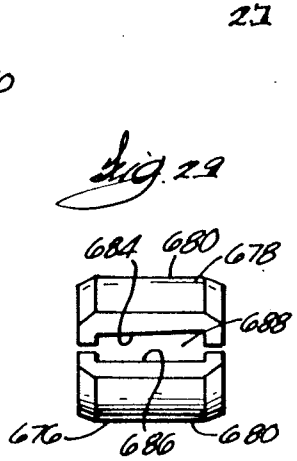
Figure 25:
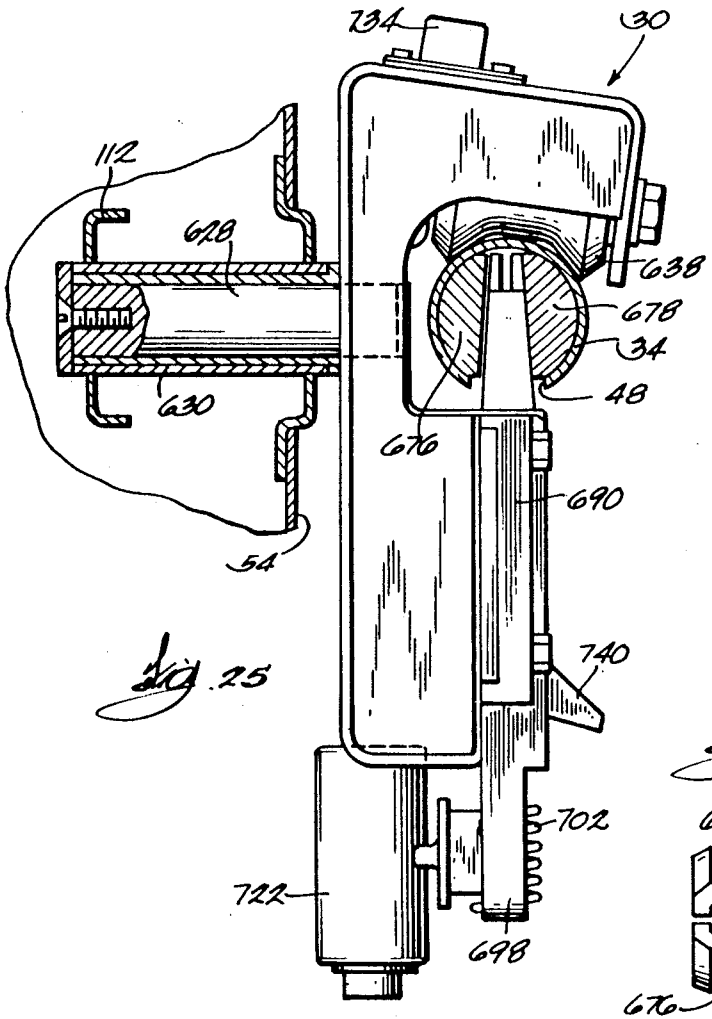
FIG. 25 is a side elevational view of a carrier illustrated in FIG. 24.

To promote reliable operation of the brake mechanism and improve overall safety, the wedge member 690 is continuously biased toward the extended position. To this end, the side walls 698 and 700 of the outer channel member 392 adjacent the lower end of the channel member are extended downwardly for a distance and then turned inwardly and upwardly as best seen in FIG. 24. The ends of the extended side walls terminate somewhat below the lower end of the wedge member and a coil spring 702, under compression, is positioned between the upwardly turned ends of the channel side walls 698 and 700 and the underside of the wedge member 690. The coil spring 702 serves to bias the wedge member upwardly relative to the channel member and to the upper rail.

To permit the upper carrier assembly 30 to move along the upper rail 34 during normal operation of the stairway passenger lift 10 when braking is not needed, the wedge member 690 is held in the retracted position against the biasing force of the bias spring 702. Referring to FIG. 26, this is accomplished by means of a controllable latch assembly 704 having a pivotable pawl 706 adapted to engage the wedge member 690 and selectively retain the wedge member 690 in the retracted position.

The pawl 706 is mounted adjacent the wedge member 690 for pivotal movement around a substantially horizontal pivot 708 extending across the interior of the inner channel member 694. One end 710 of the pawl extends downwardly through a slot 712 in the inner channel member and the lowermost end of the pawl includes a sloped face 714 which engages a complementarily shaped ledge 716 formed on the wedge member 690. When held in this position, the pawl 706 blocks upward horizontal movement of the wedge member 690 from the retracted position. A spring 718, disposed around the horizontal pivot 708, biases the end 710 of the pawl 706 into engagement with the wedge member 690.

It will be appreciated, however, that under the influence of the wedge member bias spring 702, the sloped surfaces 714 and 716 on the pawl 706 and wedge 690 will tend to pivot the pawl out of engagement with the wedge member. Thus, the pawl will only retain the wedge in the retracted position if it is positively held in place against the wedge member. To control disengagement of the pawl from the wedge, another end 720 of the pawl 706 extends substantially horizontally outwardly from the pivot 708. Downward movement of the other end 720 relative to the carrier member face 632 causes rotation of the pawl 706 around the pivot 708 and into engagement with the wedge member 690. Upward movement of the pawl end 720 releases the wedge member 690, allowing the wedge member bias spring 702 to drive the wedge member 690 between the brake members 676 and 678 so as to oppose movement of the carrier 30 relative to the rail assembly 34.

To control movement of the pawl end 720 and thereby control actuation of the brake, the brake mechanism further includes a solenoid 722 mounted to the lower end of the upper carrier assembly 30 and having a plunger 724 coupled to the end 720 of the pawl 706. When energized, the solenoid 722 is retracted causing the pawl 706 to pivot in the counter-clockwise direction as viewed in FIG. 26. This also positively biases the pawl end 710 into engagement with the wedge member 690 to retain the wedge member 690 in the retracted position.

When de-energized, the solenoid 722 no longer functions to draw the pawl end 720 downwardly. Under the influence of the wedge member bias spring 702 and the sloped surfaces 714 and 716, the pawl 706 is permitted to rotate in the clockwise direction as viewed in FIG. 26, and thereby disengage the wedge member 690 to release the wedge member for movement from the retracted to the extended position.

To provide for de-energization of the solenoid 722 in the event the speed of the upper carrier 30 relative to the rail assembly 20 exceeds a Predetermined threshold, means are provided for sensing the speed of the upper carrier 30 relative to the upper rail 34. To this end, one of the rollers 638 engaging the upper rail 34 is provided with a thin circular disc 726, mounted adjacent one end of the roller 638, and having a pair of diametrically opposed notches 728 and 730 formed in its outer periphery. The disc 726 is mounted to the end of the roller 638 by means of a screw 732 or other such fastener so that the disc 726 rotates with the roller 638 during movement of the upper carrier 30 relative to the upper rail 34.

To sense the rotational velocity of the roller 638 and, thus, the speed of the passenger lift Platform 22, a photoelectric detector 734 is mounted to the upper end of the carrier assembly 30 so as to straddle the outer periphery of the disc 726. A light source 736 and light director 738 included in the photodetector 734, are oriented so that a light conductive path between the source and receptor is ordinarily broken by the periphery of the disc 726 except when one of the notches 728 or 730 passes through the photodetector 734. Accordingly, the photodetector 734 will sense a light burst each time a notch 728 or 730 passes through the photodetector during rotation of the roller 638 and disc 726. As the number of light bursts thus detected in a given period of time is indicative of roller speed and, hence, carrier speed, appropriate speed sensing circuitry within the passenger lift platform 22 senses the speed of the carrier 30 relative to the rail assembly 20 by monitoring the rate at which such light pulses are detected.

In the event the pulse repetition rate exceeds a predetermined maximum indicative of predetermined maximum speed threshold, the speed sensing circuitry operates to de-energize the solenoid, allowing the wedge member 690 to be released in the manner described. This results in actuation of the brake to slow or stop movement of the upper carrier 30 relative to the rail assembly 20.

Following actuation of the brake, the brake can be reset by manually withdrawing the wedge member 690 from the extended position to the retracted position and allowing the pawl 706 to once again engage the wedge member 690. To facilitate retraction of the wedge member against the bias provided by the wedge member bias spring 702, a fulcrum point, in the form of a rigid metal tab 740, is mounted to the rear surface of the outer channel 692, and an aperture 742 formed in the rear surface of the outer channel 692 immediately below the tab 740 permits a rigid tool 744, having an angled or bent end portion 746, to be brought into engagement lifting the tool 744 so as to bear against the tab 740, the bent end 746 of the tool forces the wedge

690 downwardly against the upwardly directed force provided by the bias spring 702. The upper surface 748 of the lower pawl end 710 is curved so that, as the wedge is forced downwardly, the pawl 706 automatically rotates away from the wedge 690.

It will be appreciated that the construction of the brake mechanism is such that substantially fail-safe operation is provided. Thus, the mechanism tends to automatically stop the movement of the carrier relative to the rail assembly and is prevented from doing so only when the passenger lift mechanism is operating normally. Excess speed, loss of solenoid energization, or failure of the pawl will each cause the wedge member to be released and the brake mechanism to be actuated.

While a particular embodiment of the invention has been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. A lift mechanism for transporting a passenger between first and second vertically displaced locations separated by stairs, said lift mechanism comprising:

a rail extending along the stairs;

a flexible drive member disposed within said rail and adapted for movement within said rail;

a motor drive unit adapted to operatively drive said flexible drive member;

a passenger lift platform coupled to said chain and adapted to ride along said rail in response to driving movement of said flexible drive member;

wireless sensing means for sensing the position of said lift platform; and control means responsive to said wireless sensing means for controlling the movement of said platform in accordance with the position of said platform.

2. A lift mechanism in accord with claim 1 wherein said wireless sensing means includes a first wireless link adapted to communicate data from said passenger lift platform to said motor drive and a second wireless link adapted to communicate data from said motor drive unit to said passenger lift platform.

3. A lift mechanism in accordance with claim 2 wherein each of said first and second wireless links comprises an infrared link.

4. A lift mechanism in accordance with claim 3 wherein said control means includes a microprocessor-based micro-controller within each of said motor drive unit and said passenger lift platform.

5. A carrier for supporting a passenger lift platform for movement along a rail assembly of a passenger stairway lift mechanism, the stairway lift mechanism including a drive chain housed within the rail assembly, the carrier comprising:

a platform support bracket for supporting the passenger lift platform;

coupling means for coupling said platform support bracket to the chain within the rail assembly;

a pair of opposed brake members housed within the rail assembly adjacent said coupling means;

a wedge member coupled to said platform support bracket and drivable between said brake members to bias said brake members outwardly, said wedge member being movable between an extended position wherein said brake members are biased outwardly into engagement with the rail assembly to substantially prevent movement of said platform support bracket, and a retracted position wherein said brake members do not engage the rail assembly with sufficient force to substantially prevent movement of said platform support bracket; and brake control means responsive to a control input for causing said wedge member to move from said retracted position to said extended position in response to said control input whereby movement of said platform support bracket is substantially prevented following response of said brake control means to said control input.

6. A carrier in accordance with claim 5 further comprising bias means for biasing said wedge member from said retracted position toward said extended position and releasable latch means for releasably retaining said wedge member in said retracted position.

7. A carrier in accordance with claim 5 further comprising speed sensing means for the speed of said platform support bracket relative to the rail assembly and for applying said control input to paid brake control means when said speed of said platform support bracket relative to the rail assembly exceeds a predetermined limit.

8. A carrier in accordance aim 7 wherein said speed sensing means include a wheel rolling along said rail assembly.

9. A carrier in accordance with claim 8 further comprising a roller assembly coupled to said platform bracket and adapted to ride along the rail assembly for providing bi-directional movement of said platform support bracket along the rail assembly.

10. A carrier in accordance with claim 9 wherein said coupling means comprises a pair of spaced drive pins engaging the chain and wherein said wedge member is positioned substantially between said drive pins.

11. A passenger lift platform for use in a stairway wheelchair lift, said passenger lift platform comprising:

a vertical housing having a lower and an upper end, said vertical housing being adapted to be supported for movement along a rail;

a platform having a load supporting surface, said platform being pivotally joined adjacent said lower end of said vertical housing for movement between a raised generally vertical position wherein said platform is substantially folded against said vertical housing and a lowered position wherein said platform extends substantially horizontally perpendicularly from said vertical housing;

a first elongate arm coupled to said vertical housing adjacent said upper end and movable between a raised position wherein said first arm extends upwardly from said vertical housing a lowered position wherein said arm extends substantially horizontally perpendicularly outwardly from said vertical housing;

a second elongate arm coupled to said vertical housing adjacent said upper end and movable between a raised position wherein said second arm extends upwardly from said vertical housing and a lowered position wherein said second arm extends substantially horizontally perpendicularly outwardly from said vertical housing; and hydraulic actuating means for controllably raising and lowering said first and second arms.

12. A passenger lift platform in accordance with claim 1 and further including hydraulic actuating means for controllably raising and lowering said platform, said hydraulic actuating means including a hydraulic cylinder mounted within said vertical housing and a bell crank coupled between said hydraulic cylinder and said platform so as to pivot said platform between said raised and lowered positions in response to extension and retraction of said hydraulic cylinder.

13. A passenger lift platform in accordance with claim 11 wherein said vertical housing is relatively narrower in a direction away from the rail and is relatively wider in a direction along the rail.

14. A passenger lift platform in accordance with claim 13 wherein said vertical housing includes front and rear sides spaced from each other in a direction away from the rail.

15. A passenger lift platform in accordance with claim 11 wherein said actuating means includes a sprocket coupled to each of said first and second arms, a chain reeved around said sprocket and having first and second ends, resilient means engaging one of said first and second ends for biasing said chain for movement in one direction, and a hydraulic cylinder engaging said second end for drawing said chain in the opposite direction against the bias of said resilient means so that said sprocket rotates in one direction when said chain moves in said one direction and rotates in the opposite direction when said chain moves in the opposite direction.

16. A passenger lift platform in accordance with claim 15 wherein said resilient means comprises a spring having one end connected to said first end of said chain and another end connected to said vertical housing.

17. A passenger lift platform in accordance with claim 11 wherein said passenger lift platform includes independent ones of said hydraulic actuating means arranged to raise and lower said first and second arms independently of each other.

18. A passenger lift platform in accordance with claim 17 wherein each of said first and second elongate arms is substantially L-shaped.

19. A passenger lift platform for use in a stairway wheelchair lift, said passenger lift platform comprising:

a vertical housing having a lower and an upper end, said vertical housing being adapted to be supported for movement along a rail;

a platform having a load supporting surface, said platform being pivotally joined adjacent said lower end of said vertical housing for movement between a raised generally vertical position wherein said platform is substantially folded against said vertical housing and lowered position wherein said platform extends substantially horizontally perpendicularly from said vertical housing;

a first elongate arm coupled to said vertical housing adjacent said upper end and movable between a raised position wherein said first arm extends upwardly from said vertical housing and a lowered position wherein said arm extends substantially horizontally perpendicularly outwardly from said vertical housing;

a second elongate arm coupled to said vertical housing adjacent said upper end and movable between a raised position wherein said second arm extends upwardly from said vertical housing and a lowered position wherein said second arm extends substantially horizontally perpendicularly outwardly from said vertical housing; and hydraulic actuating means for controllably raising and lowering said platform, said hydraulic actuating means including a hydraulic cylinder mounted within said vertical housing and a bell crank coupled between said hydraulic cylinder and said platform so as to pivot said platform between said raised and lowered positions in response to extension and retraction of said hydraulic cylinder.

20. A passenger lift platform in accordance with claim 19 wherein said passenger lift platform further includes a user control panel.

21. A passenger lift platform in accordance with claim 20 wherein said user control panel is adapted to be detachably carried on said vertical housing.

22. A passenger lift platform in accordance with claim 19 further including a passenger seat mounted on the vertical housing and adapted for rotation from a substantially vertical storage position to a substantially horizontal use position.

23. A passenger lift platform in accordance with claim 19 wherein said platform includes an end ramp and an edge ramp, each of said end and edge ramps being pivotable from a raised position to a lowered position relative to said platform.

24. A passenger lift platform in accordance with claim 23 wherein said passenger lift platform further includes first means for raising and lowering said end ramp between said raised and lowered positions and second means for raising and lowering said edge ramp between said raised and lowered positions.

25. A passenger lift platform in accordance with claim 24 wherein said first means for raising and lowering said end ramp includes a cable coupled to said end ramp and a cylinder coupled to said cable and operable to draw such cable so as to raise said end ramp from said lowered position to said raised position.

26. A passenger lift platform in accordance with claim 25 wherein said passenger lift platform includes a pair of said end ramps and wherein said first means for raising said end ramps includes a pair of said cables coupled to individual ones of said end ramps, and a single one of said cylinders operable to simultaneously draw said cables so as to substantially simultaneously raise said end ramps from said lowered positions to said raised positions.

27. A passenger lift platform in accordance with claim 25 wherein said second means for raising and lowering said edge ramp comprises a cylinder having one end connected to said platform and another end coupled to said edge ramp through a bell crank assembly.

* * * * *